US007941307B2

(12) United States Patent
Symington et al.

(10) Patent No.: US 7,941,307 B2
(45) Date of Patent: May 10, 2011

(54) METHOD FOR CALIBRATING A MODEL OF IN-SITU FORMATION STRESS DISTRIBUTION

(75) Inventors: William A. Symington, Houston, TX (US); David P. Yale, Katy, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 1245 days.

(21) Appl. No.: 11/250,804

(22) Filed: Oct. 14, 2005

(65) Prior Publication Data

US 2006/0100837 A1 May 11, 2006

Related U.S. Application Data

(60) Provisional application No. 60/626,814, filed on Nov. 10, 2004.

(51) Int. Cl.
*G06G 7/48* (2006.01)

(52) U.S. Cl. ..... 703/10

(58) Field of Classification Search ..... 703/10
See application file for complete search history.

(56) References Cited

U.S. PATENT DOCUMENTS

| | | | | |
|---|---|---|---|---|
| 4,340,934 | A * | 7/1982 | Segesman | 702/11 |
| 5,838,634 | A * | 11/1998 | Jones et al. | 367/73 |
| 5,844,799 | A | 12/1998 | Joseph et al. | 703/2 |
| 5,905,657 | A | 5/1999 | Celniker | 703/5 |
| 6,246,963 | B1 * | 6/2001 | Cross et al. | 702/14 |
| 7,124,029 | B2 * | 10/2006 | Jammes et al. | 702/7 |
| 2002/0013687 | A1 | 1/2002 | Ortoleva | 703/10 |
| 2002/0099504 | A1 | 7/2002 | Cross et al. | 702/2 |

OTHER PUBLICATIONS

Norman R. Warpinski, "Elastic and viscoelastic calculations of stresses in sedimentary basins", 1989, SPE Formation Evaluation, vol. 4, pp. 522-530.*

Mohammed Y. Al-Qahtani et al., "A mathematical algorithm for modeling geomechanical rock properties of the Khuff and Pre-Khuff reservoirs in Ghawar field", 2001, Society of Petroleum Engineers SPE 68194, pp. 1-8.*

C.L. Cipolla et al., "Practical application of in-situ stress profiles", 1994, Society of Petroleum Engineers, SPE 28607, pp. 487-499.*

Anwar Husen Akbar Ali et al., "Watching rocks change-mechanical earth modeling", Summer 2003, Oilfield Review, pp. 22-39.*

Blanton, T. L. et al, "Stress Magnitudes from Logs; Effects of Tectonic Strains and Temperature", *SPE Reservoir, Eval. & Eng. 2*, vol. 1, Feb. 1999, pp. 62-68.

Charlier, R. et al, "Numerical Simulation of the Coupled Behavior of Faults During the Depletion of a High-Pressure/High-Temperature Reservoir", SPE 78199, 2002, pp. 1-12.

(Continued)

*Primary Examiner* — Jason Proctor
*Assistant Examiner* — Russ Guill
(74) *Attorney, Agent, or Firm* — ExxonMobil Upstream Research Company-Law Department

(57) ABSTRACT

A method for producing a substantially calibrated numerical model, which can be used for calculating a stress on any point in a formation, accounts for a formation's geologic history using at least one virtual formation condition to effectively "create" the present-day, virgin stress distribution that correlates, within acceptable deviation limits, to actual field stress measurement data obtained for the formation. A virtual formation condition may describe an elastic rock property (e.g., Poisson ratio, Young's modulus), a plastic rock property (e.g., friction angle, cohesion) and/or a geologic process (e.g., tectonics, erosion) considered pertinent to developing a stratigraphic model suitable for performing the desired stress analysis of the formation.

34 Claims, 6 Drawing Sheets

OTHER PUBLICATIONS

Frederiksen, S. et al, "A Numerical Dynamic Model for the Norwegian-Danish Basin" *Tectonophysics*, 343, 2001, pp. 165-183.
Fredrich, J. T. et al, "Geomechanical Modeling of Reservoir Compaction, Surface Subsidence, and Casing Damage at the Belridge Diatomite Field", *SPE Reservoir Eval. & Eng.3*, vol. 4, Aug. 2000, pp. 348-359.
Fredrich, J. T. et al, "Stress Perturbations Adjacent to Salt Bodies in the Deepwater Gulf of Mexico", SPE 84554, 2003, pp. 1-14.
Fredrich, J. T. et al, "Three-Dimensional Geomechanical Simulation of Reservoir Compaction and Implications for Well Failures in the Belridge Diatomite", SPE 36698, 1996, pp. 195-210.
Gatens III, J. M. et al, "In-Situ Stress Tests and Acoustic Logs Determine Mechanical Properties and Stress Profiles in the Devonian Shales", SPE 18523, 1990, pp. 248-254.
Hansen, K. S. et al, "Earth Stress Measurements in the South Belridge Oil Field, Kern County, California", SPE Formation Evaluation, Dec. 1989, pp. 541-549.
Hansen, K. S. et al, "Finite-Element Modeling Depletion-Induced Reservoir Compaction and Surface Subsidence in the South Belridge Oil Field, California", SPE 26074, 1993, pp. 437-452.
Hansen, K. S. et al, "Modeling of Reservoir Compaction and Surface Subsidence at South Belridge", *SPE Production & Facilities*, Aug. 1995, pp. 134-143.
Hilbert, L. B. et al, "Field-Scale and Wellbore Modeling of Compaction-Induced Casing Failures", *SPE Drill. & Completion*, 14:2, Jun. 1999, pp. 92-101.
Holditch, S. A., "Pretreatment Formation Evaluation", *Recent Advances in Hydraulic Fracturing*, SPE Monograph vol. 12, Chapter 2 (Henry L. Doherty Series), 1989, pp, 39-56.
Kenter, C. J. et al, "Geomechanics and 4D: Evaluation of Reservoir Characteristics from Timeshifts in the Overburden", Gulf Rocks 2004, 6 $^{th}$ North America Rock Mechanics Symposium (NARMS): Rock Mechanics Across Borders and Disciplines, Houston, Texas, Jun. 5-9, 2004, ARMA/NARMS 04-627.
Le Pourhiet, L. et al, "Initial Crustal Thickness Geometry Controls on the Extension in a Back Arc Domain: Case of the Gulf of Corinth", *Tectonics*, vol. 22, No. 4, 2003, pp. 6-1-6-14.
Marotta, A. M. et al, "Numerical Models of Tectonic Deformation at the Baltica-Avalonia Transition Zone During the Paleocene Phase of Inversion", *Tectonophysics*, 373, 2003, pp, 25-37.
Molenaar, M. M. et al, "Applying Geo-Mechanics and 4D: '4D In-Situ Stress' as a Complementary Tool for Optimizing Field Management", Gulf Rocks 2004, 6 $^{th}$ North America Rock Mechanics Symposium (NARMS): Rock Mechanics Across Borders and Disciplines, Houston, Texas, Jun. 5-9, 2004, ARMA/NARMS 04-639, pp, 1-7.
Pattillo, P. D. et al, "Analysis of Horizontal Casing Integrity in the Valhall Field" SPE 78204, 2002, pp. 1-10.
Pattillo, P. D. et al, "Reservoir Compaction and Seafloor Subsidence at Valhall", SPE 47274, 1998, pp. 377-386.
Plischke, B., "Finite Element Analysis of Compaction and Subsidence —Experience Gained from Several Chalk Fields", SPE 28129, 1994, pp. 795-802.
Smart, K. J. et al, "Integrated Structural Analysis and Geomechanical Modeling: an Aid to Reservoir Exploration and Development", Gulf Rocks 2004, 6$^{th}$ North American Rock Mechanics Symposium (NARMS): Rock Mechanics Across Borders and Disciplines, Houston, Texas, Jun. 5-9, 2004, ARMA/NARMS 04-470.
European Standard Search Report No. RS112183US, dated Apr. 29, 2005, 1 pg.

* cited by examiner $\sigma_{horiz-1} = 1.20\ \sigma_{vert}$
$\sigma_{horiz-2} = 0.65\ \sigma_{vert}$

METHOD FOR CALIBRATING A MODEL OF IN-SITU FORMATION STRESS DISTRIBUTION

CROSS REFERENCE TO RELATED APPLICATIONS

This application claims the benefit of U.S. provisional application No. 60/626,814, filed Nov. 10, 2004.

FIELD OF THE INVENTION

The present invention relates to the field of stress analysis and, in particular, to a method of calibrating a numerical model used for calculating stress on any point in a geologic formation.

BACKGROUND OF THE INVENTION

Many practical geomechanical problems require an estimate of the stresses in a formation beneath the earth's surface, whether the formation lies beneath a mass of land, water, or both land and water. Often, when time and costs are not a limiting factor, the stresses at a particular area of interest in a particular formation can be assessed using field stress measurement methods such as hydraulic fracturing methods, borehole ellipticity/breakout methods, formation integrity tests, and mini-frac tests, among other methods. Unfortunately, however, field stress measurements taken at one point in a formation can provide only a limited understanding, if any, of the stress distribution throughout the formation of interest. So, it has been difficult to determine, with reasonable accuracy and resolution, the stresses at other points in the formation, outside the area in which actual field stress measurements were obtained.

Field stress measurements taken in one region of a formation have been difficult to extrapolate to other points in the formation because the distribution of stresses in the formation can depend heavily on topography, far-field tectonic forces and local geologic history, among other factors. Consequently, before Applicants' invention, methods used to estimate the distribution of stresses in a formation have produced relatively inaccurate and unresolved stress values for other points in the formation outside the area in which actual field stress measurements were obtained.

One simplified approach that has been used previously, involves first determining a principal vertical stress, $\sigma_{vert}$, in which $\sigma_{vert}$ is simply based on the weight of the overburden, or weight of rock, above the point of interest in the formation. Second, each principal horizontal stress, $\sigma_{horiz\text{-}1}$ and $\sigma_{horiz\text{-}2}$, is presumed to be proportional to $\sigma_{vert}$ by a constant, but typically different, factor. For example, in the 1993 SPE paper (# 26074) entitled "*Finite-Element Modeling of Depletion-Induced Reservoir Compaction and Surface Subsidence in the South Belridge Oil Field, California*," Hansen et al. suggested that the lesser of the two principal horizontal stresses equals 0.65 $\sigma_{vert}$, while the greater of the two principal horizontal stresses equals 1.20 $\sigma_{vert}$.

For purposes of determining a vertical stress with limited effort and expense, Hansen et al.'s approach provides a reasonable first order approximation for the formation's vertical stress, $\sigma_{vert}$. However, the proportionality assumes that for any given formation, a horizontal stress is consistently related to the formation's vertical stress, where the overburden weight (used to determine $\sigma_{vert}$) is based on an average rock density for a single point or area in the formation. This can be acceptable for a simple first order approximation. However, such an approximation implicitly neglects variability in rock properties and topography throughout a formation, frequently found in the formations of interest, and past geologic processes (e.g., deposition, erosion, tectonics, etc.) that can contribute to a formation's present-day stress distribution. So, substantial variations in the formation's stress distribution, arising from variability in rock properties and geologic processes leading to the formation's creation, are not accounted for using a formation stress approximation method like the one disclosed by Hansen et al.

Consequently, even if the initial approximation of $\sigma_{vert}$ is a reasonable one, a simplified approximation method can produce an over-simplified model of a formation's stress distribution, particularly with respect to the principal horizontal stresses. Such an over-simplified model of a formation's stress distribution, like that produced using the Hansen et al. assumptions, for instance, can produce a relatively less resolved and less accurate estimate of stresses at any point in the formation. In turn, the over-simplified model tends to be less helpful in predicting the effect, if any, man-induced stresses (e.g., injecting a fluid at high pressure, depleting formation fluids, formation fracturing, explosion, etc.) might have on different area(s) of interest in the formation.

Another conventional approach, discussed in Blanton et al. ("*Stress Magnitudes from Logs: Effects of Tectonic Strains and Temperature" SPE Reservoir Eval. & Eng.* 2:1:February 1999 and referencing Gatens et al. "*In-Situ Stress Tests and Acoustic Logs Determine Mechanical Properties and Stress Profiles in the Devonian Shales*" SPE 18523; 1990), is to first determine a $\sigma_{vert}$ based on present-day overburden weight. Then the corresponding $\sigma_{horiz\text{-}2}$ is estimated by Equation (1), using present-day Poisson ratio values and $\sigma_{vert}$.

$$\sigma_{horiz-2} = \frac{v_{Present}}{1 - v_{Present}}(\sigma_{vert} - \alpha_p p) + \alpha_p p \tag{1}$$

where $v_{present}$ is a measured present-day Poisson ratio value (dimensionless)

$\sigma_{horiz\text{-}2}$ is a minimum principal horizontal stress (psi)

$\sigma_{vert}$ is a principal vertical stress (psi)

$\alpha_p$ is Biot's poroelastic constant (dimensionless)

p is pore pressure (psi)

Note: Eq. (1) as shown has been amended to conform with the nomenclature of the present application.

Well logs are used to produce a set of present-day Poisson ratio, $v_{Present}$, values as a function of depth. Eq. (1) is then used to calculate $\sigma_{horiz\text{-}2}$ values as a function of depth for a location where calibrated data is available.

Whether calculated according to Hansen et al. (where $\sigma_{horiz\text{-}2}$ and $\sigma_{horiz\text{-}1}$ are multipliers of $\sigma_{vert}$) or by Eq. (1), the actual stress measurements for one location are then used to assess a formation's present-day stress distribution by simply extrapolating known, present-day stress measurements from one location to another distant location one-dimensionally. That is, stresses, whether vertical or horizontal, at any given depth in the formation are assumed to be a function of depth from the surface and extending substantially uniformly, radially outward within the radial plane from one area, where actual field stress data is available, to any other point in the location, where no such data is available.

In more pictorial terms, this simplified approach to modeling a formation's stress distribution assumes a formation is depicted, in effect, by an infinite number of spoked wheels, one atop the other. Meanwhile, actual $\sigma_{vert}$ is determined according to changes in depth, and hence, horizontal stresses are assumed as "known" at each wheel's hub. In turn, these vertical and horizontal stresses are then extrapolated radially outward, along any spoke (also assuming an infinite number of spokes around each "hub" area) to any other point of interest in the formation.

And to the extent field data is available at two or more separate areas of a formation, then a formation model, based on this simplified approach, could be better refined by simply taking some intermediate value (i.e., interpolating) between different stress results obtained for the point(s) of interest, as produced by using multiple sets of stress data taken/obtained for multiple locations throughout the formation and producing corresponding sets of overlapping spoked-wheel stacks for depicting the formation. And again, to the extent there is no convergence for the spokes in the same radial plane extending out from the independent hub data sets to where no stress data is available, then an intermediate or interpolated stress value is typically generated, accordingly.

Of course, taking and/or obtaining field stress data at strategic and multiple locations throughout a formation, to produce the desired stress analysis, is both time consuming and costly, if not sometimes prohibitive for a lack of time, money or both. Consequently, it would be preferable to have a method for calibrating a model of a formation's stress distribution that more accurately reflects the formation's actual, present-day stress distribution for the intended stress analysis, and more preferably, have a method that can produce such a model using stress data from a single area of a formation. For example, such a calibration procedure should develop, within the desired degree of certainty, a model of the formation's stress distribution that more accurately captures the 3-dimensional stress variations that typically exist in a formation.

Consequently, a different approach is required for developing a truer model of a formation's stress distribution from stress data at one or more location(s) versus developing an artificial 3-D construct, like that used by conventional methods. Again, such conventional methods basically assume that principal stresses at one location can be extended one-dimensionally, radially outward (i.e., extrapolated) to any other location, where no such data is available, while effectively neglecting rock property variations and/or geohistorical effects on a formation's present-day stress distribution, whether in a virgin (i.e., before a man-induced, stress-altering event occurs in the formation) or non-virgin state. Moreover, these three-dimensional stress variations serve to redistribute the variable gravitational loads caused by topographic relief, which have been ignored in the conventional methods discussed above. While ignoring topographic relief can sometimes produce an adequate model for certain formations, there is often a need for a better characterization of the stress distribution in a formation as a whole.

Therefore, despite the reasonable correlation between $\sigma_{vert}$ and the weight of a formation's rock, certain subsequent assumptions can produce a less resolved and less accurate estimate of the formation's stress distribution suitable for performing the desired formation stress analysis. For example, assumptions such as: (1) that $\sigma_{vert}$ is correlated to each principal horizontal stress, $\sigma_{horiz\text{-}1}$ and $\sigma_{horiz\text{-}2}$, by a predetermined constant factor (e.g., 1.20 and 0.65, respectively) or by Eq. (1) and/or (2) that the formation's rock properties are substantially homogeneous throughout the formation, can significantly reduce the resolution and accuracy of a stress distribution model for a formation based on such assumptions. Accordingly, there is a need for an improved method of determining that a model of a formation's stress distribution is suitably calibrated to the formation of interest, so that the desired stress analysis at any point in the formation can be performed with improved accuracy and/or resolution versus more simplified formation modeling methods previously used.

SUMMARY OF THE INVENTION

According to one aspect of the present invention, there is provided a method for producing a substantially calibrated numerical model, which can be used for calculating a stress on any point in a formation, the method comprising, in any order consistent with the claim wording, the elements of:

(a) predetermining a number, n, of strata suitable for modeling the formation, wherein n=a whole integer $\geqq 1$ and $s_n$ independently designates each stratum, respectively;

(b) predetermining for each $s_n$ a corresponding thickness, $H_n$, and a corresponding present-day elastic rock property, $ERP_{n,Present}$;

(c) obtaining a numerical modeling program adapted to performing stress calculations and producing a formation-stress analysis using the stress calculations;

(d) obtaining stress calibration data for at least one location in the formation, $L_f$ stress calibration data, wherein for a first location in the formation, $L_f=L_1$;

(e) predetermining at least one set, i, of values comprising a burial elastic rock property corresponding to each $s_n$, $ERP_{n,Burial\text{-}i}$, wherein each $ERP_{n,Burial\text{-}i} \neq ERP_{n,Present}$, wherein for i=1 a first set of values for burial elastic rock property, $ERP_{n,Burial\text{-}1}$, is predetermined;

(f) predetermining at least a $1^{st}$ gravitational load, $GL_1$, associated with the formation;

(g) using at least each of the $GL_1$, the $H_n$ and the $ERP_{n,Burial\text{-}i}$ values to perform stress calculations on multiple points in the formation so that at least one modeled formation-stress analysis, $FSA_i$, can be produced, wherein for i=1 a first modeled formation-stress analysis, $FSA_i$, is produced;

(h) producing from each $FSA_1$ a corresponding set, i, of modeled stress profiles for $L_f$, $SP_{i,Lf}$, having at least one principal stress, wherein for i=1 and $L_1$ a first set of modeled stress profiles, $SP_{1,L1}$, is produced;

(i) comparing each $SP_{i,Lf}$ to the $L_f$ stress calibration data, wherein for i=1 and $L_1$, $SP_{1,L1}$ is compared to the $L_1$ stress calibration data;

(j) determining a degree of deviation, $D_i$, from comparing, respectively, each of $SP_{i,Lf}$ and the $L_f$ stress calibration data, wherein for i=1 a first degree of deviation, $D_1$, is determined from comparing at least the $SP_{1,L1}$ and the $L_1$ stress calibration data; and (k) obtaining the substantially calibrated numerical model provided that $D_1$ is acceptable for the formation-stress analysis desired; otherwise, iterating the above-described process for i=2, 3,. . . until $D_i$ is less than a pre-determined maximum deviation.

According to another aspect of the present invention, there is provided a method for producing a substantially calibrated numerical model, which can be used for calculating a stress on any point in a formation, the method comprising, in any order consistent with the claim wording, the elements of:

(a) predetermining a number, n, of strata suitable for modeling the formation, wherein n=a whole integer$\geqq 1$ and $s_n$ independently designates each stratum, respectively;

(b) predetermining for each $s_n$ a corresponding thickness, $H_n$, and a corresponding present-day Poisson ratio, $v_{n,Present}$;

(c) obtaining a numerical modeling program adapted to performing stress calculations and producing a formation-stress analysis using the stress calculations;

(d) obtaining stress calibration data for at least one location in the formation, $L_f$ stress calibration data, wherein for a first location in the formation, $L_f=L_1$;

(e) predetermining at least one set, i, of values comprising a burial Poisson ratio corresponding to each $s_n$, $v_{n,Burial-i}$, wherein each $v_{n,Burial-i} \leqq 0.5$ and each $v_{n,Burial-i} > v_{n,Present}$, wherein for i=1 a first set of values for burial Poisson ratio, $v_{n,Burial-1}$, is predetermined;

(f) predetermining at least a $1^{st}$ gravitational load, $GL_1$, associated with the formation;

(g) using at least each of the $GL_1$, the $H_n$ and the $v_{n,Burial-i}$ values to perform stress calculations on multiple points in the formation so that at least one modeled formation-stress analysis, $FSA_i$, can be produced, wherein for i=1 a first modeled formation-stress analysis, $FSA_1$, is produced;

(h) producing from each $FSA_i$ a corresponding set, i, of modeled stress profiles for $L_f$, $SP_{i,Lf}$, having at least one principal stress, wherein for i=1 and $L_1$, a first set of modeled stress profiles, $SP_{1,L1}$, is produced;

(i) comparing each $SP_{i,Lf}$ to the $L_f$ stress calibration data, wherein for i=1 and $L_1$, $SP_{1,L1}$ is compared to the $L_f$ stress calibration data;

(j) determining a degree of deviation, $D_i$, from comparing, respectively, each of $SP_{i,Lf}$ and the $L_f$ stress calibration data, wherein for i=1 a first degree of deviation, $D_1$, is determined from comparing at least the $SP_{1,L1}$ and the $L_1$ stress calibration data; and (k) obtaining the substantially calibrated numerical model provided that $D_1$ is acceptable for the formation-stress analysis desired; otherwise, iterating the above-described process for i=2, 3,. . . until $D_i$ is less than a pre-determined maximum deviation.

BRIEF DESCRIPTION OF THE DRAWINGS

The process of the present invention will be better understood by referring to the following detailed description of preferred embodiments and the drawings referenced therein, in which.

DETAILED DESCRIPTION OF THE PREFERRED EMBODIMENTS

Definitions

Figure 1A:
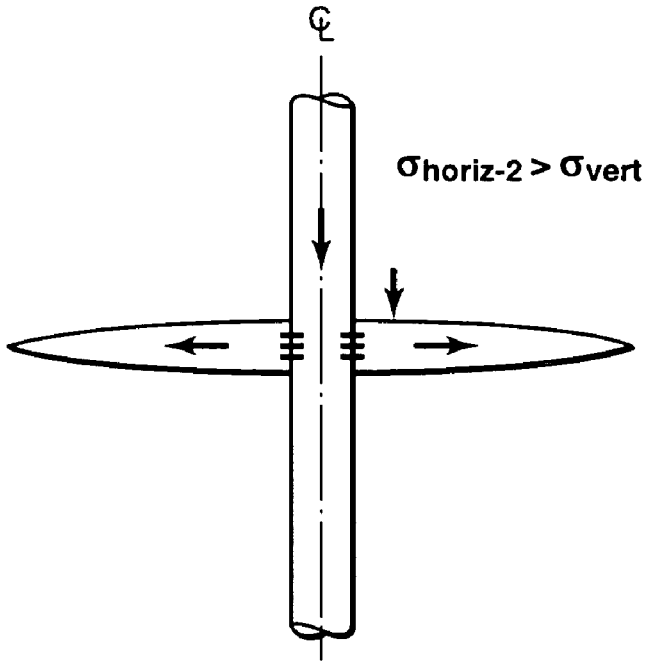
FIG. 1A (PRIOR ART)
FIG. 1A is a schematic representation of a horizontal fracture.

"Burial" means relating to a geologic process, whether continuous or discontinuous and whether related to sedimentary deposition, volcanic eruption and/or other geologic process wherein multiple strata are placed in a substantially successive manner, one stratum atop another, in a corresponding series of stratum-producing phases leading to a formation's creation. As used herein, where the term "burial" is associated with a rock property value (e.g., Poisson Ratio, Young's Modulus, etc.) for a stratum of interest, the term designates a virtual value of the rock property value for each stratum considered pertinent to developing a stratigraphic model suitable for performing the desired stress analysis of the formation. Depending on the formation, the oldest stratum and the successively newer strata of interest can be produced in any one of the primary geologic eras, Cenozoic (present-day to ~$65\times10^6$ yrs.), Mesozoic (~$65\text{-}225\times10^6$ yrs.), Paleozoic (~$225\text{-}600\times10^6$ yrs.) or Precambrian (~$600\times10^6$ yrs. to origin of planet earth).

"Lithology" means a description of the physical and approximate compositional character of a rock based on a variety of rock attributes, including, without limitation, color, structures, grain size and mineralogic components. One or more of these attributes may be determined by visual evaluation (by eye alone or assisted by a magnifier), seismic interpretation and/or well log interpretation.

"Stress-Inducing Force" means an action of at least one force, load and/or constraint on a body of material that tends to strain the body.

"Strain" means a measure of the extent to which a body of material is deformed and/or distorted when it is subjected to a stress-inducing force. Examples of the body's deformation or distortion can include, without limitation, changes in the body's length (e.g., linear strain), volume (e.g., bulk strain) and/or a lateral displacement between two substantially parallel planes of material within the body (e.g., shear strain).

"Stress" means a measure of inter-particle forces arising within a body of material resisting deformation and/or distortion, in response to a stress-inducing force applied to the body, as particles within the body of material work to resist separation, compression and/or sliding.

"Principal Stress" means any one of three inherent normal stresses, each perpendicular to the other, in a predetermined coordinate system where the 3 corresponding shear stresses are equal to zero. Generally, though not always, one of the principal stresses is substantially vertical in a formation, while the two remaining principal stresses are substantially horizontal. While there is no requirement for the principal stresses to be vertical or horizontal, for ease of discussion herein, the three principal stresses, are referred to as principal vertical stress, $\sigma_{vert}$, greater principal horizontal stress, $\sigma_{horiz-1}$, and lesser principal horizontal stress, $\sigma_{horiz-2}$.

"Poisson Ratio" or "v" means, for a substantially elastic body of material when placed under a substantially uniaxial stress, the ratio of the strain normal to the uniaxial stress to the strain parallel to the uniaxial stress.

"Elastic stress-to-strain modulus" means a ratio of stress applied to a body vs. the strain produced. Elastic stress-to-strain moduli include, without limitation, Young's modulus, E, bulk modulus, K, and shear modulus, G.

"Young's Modulus" or "E" means, for a substantially elastic body of material when placed under a substantially uniaxial stress less than the material's yield strength, whether a tension or compression stress, the ratio of the uniaxial stress, acting to change the body's length (parallel to the stress), to the fractional change in the body's length.

"Elastic" means a body of material capable of sustaining deformation and/or distortion without permanent loss of size or shape in response to a stress-inducing force, whether the body's response is linear elastic or non-linear elastic.

"Inelastic" or "Plastic" means that any deformation and/or distortion to a body of material subjected to a stress-inducing force is permanent, i.e. deformation/distortion remains after the force is removed.

"Yield Strength" means the stress value at which deformation resulting from a stress-inducing force becomes permanent. At that stress value, a body of material, which previously exhibited an elastic response, will begin to exhibit a plastic response to the stress-inducing force.

"Subsurface" means beneath the top surface of any mass of land at any elevation or over a range of elevations, whether above, below or at sea level, and/or beneath the floor surface of any mass of water, whether above, below or at sea level.

"Formation" means a subsurface region, regardless of size, comprising an aggregation of subsurface sedimentary, metamorphic and/or igneous matter, whether consolidated or unconsolidated, and other subsurface matter, whether in a solid, semi-solid, liquid and/or gaseous state, related to the geological development of the subsurface region. A formation may contain numerous geologic strata of different ages, textures and mineralogic compositions. A formation can refer to a single set of related geologic strata of a specific rock type or to a whole set of geologic strata of different rock types that contribute to or are encountered in, for example, without limitation, (i) the creation, generation and/or entrapment of hydrocarbons or minerals and (ii) the execution of processes used to extract hydrocarbons or minerals from the subsurface.

"Stratum" means a stratigraphic layer, whether a chronostratigraphic and/or lithostratigraphic layer, in a formation. A "chronostratigraphic layer" refers to rock that has been deposited within a given geological time interval, while rock in a "lithostratigraphic layer" refers to rock having a substantially similar composition of matter throughout the layer, whether in the same geological time interval or not. Often, though not always, a chronostratigraphic layer also has a substantially similar composition of matter throughout the layer and is compositionally different from any adjacent layer. Strata boundaries can be derived for example, without limitation, from analysis of samples extracted from the formation, a lithologic interpretation of geological information about the formation, and/or seismic interpretation.

"Tectonic" means pertaining to, causing or arising from a subsurface region's movement and/or deformation, whether by vibration and/or displacement, including, without limitation, rock faulting, rock folding and/or a volcanic event.

"Calibrated" means to bring a numerical model to a state consistent with observed conditions within a degree of deviation acceptable for the desired analysis. Typically, those skilled in the art of formation modeling will calibrate a model to a virgin stress distribution (i.e., before any man-induced, stress-altering event occurs in the formation). It will be understood, however, that a model can be calibrated to another stress state of interest, including, without limitation, a formation's present-day, non-virgin stress distribution, by first calibrating to a virgin stress distribution based on stress data obtained (i) from at least one location in the formation not materially affected by the man-induced event and/or (ii) before the man-induced event occurred in the formation. Once a formation is calibrated to it's virgin stress distribution, any man-induced, stress-altering events can then be accounted for to bring the model to a present-day, non-virgin stress distribution.

Discussion

As discussed above, simplified formation modeling methods have used field stress measurements taken in one region of a formation for simply extrapolating to another region. As noted above, however, these simplified modeling approaches can yield reduced resolution and accuracy in determining a formation's stress distribution. One reason for this shortcoming arises from the complexity and uncertainty about how the formation was created and the attendant rock properties that arise during creation. So, it would be most preferable to have specific information about the geologic processes and rock properties related to a formation's present-day, virgin stress distribution, which evolved geologically over a span of millions of years. If such information was available, the formation's stress distribution could be better understood, and accordingly, perhaps the stress measurements could be better extrapolated from one region to another in the formation.

Unfortunately, it is particularly problematic to determine, at least with any substantial certainty, specific information about the actual geologic processes and related rock properties that led, in fact, to a formation's present-day, virgin stress distribution. Consequently, for simplicity, a formation's stress distribution has generally been treated as relatively homogeneous and consistent throughout the formation.

So, as mentioned above, one approach for estimating a stress distribution at one region based on calibration data from another region in a formation has assumed that variable rock properties and topographic relief can be substantially ignored and that there is a relatively fixed relationship between $\sigma_{vert}$ and $\sigma_{horiz-1}$ and $\sigma_{horiz-2}$, not only under present-day conditions, whether virgin or non-virgin, but also across the span of time covering the formation's geologic history. For example, conventional techniques for stress analysis for determining a formation's virgin stress distribution have relied on (1) an initial present-day stress estimate at one location, where $\sigma_{horiz-1}$ and $\sigma_{horiz-2}$ are multipliers of $\sigma_{vert}$ and (2) present-day rock properties.

These types of assumptions effectively neglect the effects of a formation's geologic history. And accordingly, they fail to account for the complex array of geologic processes and variable rock properties that produce the formation's present-day, virgin stress distribution.

Consequently, a virtual formation condition can be varied until a stratigraphic model of the formation is substantially calibrated. In turn, such a calibrated model of the formation can better depict the formation's present-day, virgin stress distribution, and accordingly, when necessary, can help depict a formation's non-virgin stress distribution (i.e., after accounting for the man-induced event's stress-altering effect on an initial present-day, virgin stress distribution, which is first established). So, to account for a formation's geologic history, the Applicants use at least one virtual formation condition, whether it is a rock property and/or geologic event. A virtual formation condition is imaginary, that is, the condition did not necessarily ever exist, in fact. Also, a virtual formation condition can be varied alone, or with other formation conditions to effectively "create" the present-day, virgin stress distribution that correlates, within acceptable deviation limits, to actual field stress measurement data obtained for the formation. Furthermore, a virtual formation condition may describe, for example, an elastic rock property (e.g., Poisson ratio, Young's modulus), a plastic rock property (e.g., friction angle, cohesion) and/or a geologic process (e.g., tectonics, erosion) considered pertinent to developing a stratigraphic model suitable for performing the desired stress analysis of the formation.

So, since a virtual formation condition is imaginary, and does not necessarily specify a historically true and accurate value for a rock property or geologic process, it, nonetheless, describes a value or process, that, in its effect, helps account for the formation stress distribution arising over geologic time from the complex interaction of variable rock properties and geologic processes. In turn, each virtual formation condition, considered pertinent to producing a calibrated model representing the formation's stress distribution, can be varied until a stratigraphic model is obtained that is substantially calibrated, within the desired degree of deviation, to the formation's present-day, virgin stress distribution.

By producing a more accurate model for present-day, virgin stress distribution, more accurate estimates can be produced for stress distributions affecting and/or resulting from man-induced activities. Thus, the Applicants' model calibration procedure can produce a more accurate representation of the stress distribution in the formation prior to and after man-induced stress-altering forces imposed on the formation, including, for example, without limitation, injecting a fluid at high pressure, depleting formation fluids, formation fracturing, and explosion.

Briefly, the method of the invention uses both actual and virtual formation conditions, wherein at least one virtual formation condition can be varied until a substantially calibrated stratigraphic model of the formation's stress distribution is obtained. More specifically, by accounting for at least one variable rock property and, if desired, accounting as well for a geologic process that may have occurred during a formation's development, a more accurate model (versus conventional models) of a formation's stress distribution can be produced. For example, the Applicants found that principal horizontal stress estimates produced using conventional methods are generally lower than actual principal horizontal stresses. In contrast, the Applicants found that accounting for changes in rock properties, as well as geologic processes, produces a more accurate model of a formation's stress distribution by better accounting for the complex stress distribution produced while the formation was created.

Rocks generally behave in an elastic and/or plastic manner in response to a stress-inducing force including, without limitation, gravitational load, compression and tension. Often, rocks will exhibit elastic behavior for a time and then change to plastic behavior.

The detailed discussion below refers, in large part, to elastic rock properties and elastic modeling of a formation. However, in view of this disclosure, it will be understood, by those skilled in the art, how the invention can be applied to elastic-plastic and plastic models, using plastic rock properties, alone or in combination with elastic rock properties. Examples of elastic rock properties include, without limitation, Poisson ratio, v, and elastic stress-to-strain moduli, including, without limitation, Young's modulus, E, bulk modulus, K, and shear modulus, G. Examples of plastic rock properties include, without limitation, friction angle, $\phi$, cohesion, c, yield stress and hardening parameters.

One elastic property that can change as the formation is created is the Poisson ratio, v. In many cases, changes in v tend to be more significant in affecting stress distribution due to burial than other elastic rock properties, such as elastic stress-to-strain moduli, including, without limitation, Young's modulus, E, bulk modulus, K, and shear modulus, G. While the calibration method discussed below can be performed by accounting for changes in one or more elastic stress-to-strain moduli, the Applicants believe that, in many cases, v will affect a formation's virgin stress distribution more significantly than other elastic properties and, therefore, for ease of discussion, reference will be made to v alone. However, it will be understood that changes in one or more elastic stress-to-strain moduli can be accounted for, alone or in combination with v, in the method, if desired. For example, under certain tectonic displacement conditions, E may be more important in determining a formation's present-day, virgin stress distribution. Accordingly, the model for such a formation may be preferably calibrated by iterating with one or more virtual E values, instead of virtual v values, or perhaps both virtual E and v values may be preferred for performing the calibration method.

So, for an elastic system, the model uses present-day Poisson ratio, $v_{Present}$, (e.g., an actual formation condition) as well as Poisson ratio during burial, $v_{Burial}$, (e.g., a virtual formation condition). Of course, since the sediments now forming the rocks were buried millions of years ago and rock properties have now changed, it is not possible to measure the actual $v_{Burial}$. Also, because all strata in a formation were not formed at the same time, but usually over a span of thousands to millions of years, an exact measurement of $v_{Burial}$ (assuming such a measurement could be made) may not produce a rigorously accurate model of the formation's stress distribution. Therefore, as used herein, burial rock properties, in particular $v_{Burial}$, will be understood to mean virtual $v_{Burial}$ values, which can be varied, as necessary, to ultimately produce a calibrated model of the formation's stress distribution.

A formation typically has a number, n, of strata. Each stratum is independently designated herein by $s_n$. Also, as noted above, each stratum, $s_n$, in a formation is a chronostratigraphic and/or lithostratigraphic layer of rock. Generally, though not always, the layer has a substantially similar composition throughout the layer and is compositionally different from any adjacent layer. Thus, each $s_n$ usually has different rock properties. Typically, those skilled in the art assume substantially homogeneous rock properties throughout a stratum. However, where appropriate, using a suitable modeling program, it is possible to account for significant differences in rock properties within a stratum. But, for ease of discussion, the strata referenced herein will be assumed to have substantially homogeneous rock properties throughout each stratum. Accordingly, a set of predetermined present-day Poisson ratios, $v_{1\ to\ n,Present}$, values provides a corresponding $v_{Present}$ value for each set of strata, $s_{1\ to\ n}$, identified in the formation of interest.

In some cases, insufficient data may be available for each stratum. For example, it could be assumed the elastic and plastic rock properties for one or more layers above and/or below the stratum of interest are the same or similar. Accordingly, a $v_{Present}$ value for one $s_n$ may be used to estimate a $v_{Present}$ value for another $s_n$. However, it will be understood that accuracy and resolution will be improved with more accurate characterization of rock properties, corresponding to each identified stratum.

Also, the relative thickness, $H_n$, of each stratum, $s_n$, and, hence, the relative depth of each $s_n$ often change through the formation. As discussed above, conventional stress distribution methods have ignored these types of variations in a formation's stratigraphy (i.e., topographic relief is ignored). Accordingly, contributions that rock properties and gravitational loads can make to a formation's virgin stress distribution will vary according to these stratigraphic variations. So, the calibration method accounts for these stratigraphic variations. In turn, the corresponding effects these stratigraphic variations have on a rock property value for each $s_n$ and each $s_n$'s gravitational load contribution will be accounted for. This, in turn contributes, in part, to a formation's stress model, calibrated according to the claimed method, to have improved accuracy and resolution of the formation's virgin stress distribution vs. conventional method of calibration, which ignore such stratigraphic variations.

Values for $v_{Burial}$ can be estimated by a number of techniques. Estimates for $v_{Burial}$ can be made empirically and/or quantitatively. In all cases, however, each $v_{n,Burial}$ is greater than each $v_{n,Present}$. Also, $v_{Burial}$ is less than or equal to 0.5, since a body of material having a Poisson ratio greater than 0.5 would increase in size under compression, which no material, including rock, is able to do when compressed.

Empirical $v_{Burial}$ values can be made using a variety of techniques apparent to those skilled in the art. For example, $v_{Burial}$ values can be obtained by making a best-educated selection of $v_{Burial}$ for a given lithologic description, in light of corresponding $v_{Present}$ values, and/or reviewing relevant literature data. Also, $v_{Burial}$ values may be obtained using one or more quantitative relationships between $v_{Burial}$ and an actual or virtual formation property and/or an actual or virtual rock property related to $v_{Burial}$. Suitable quantitative relationships that can be derived between $v_{Burial}$ and the appropriate formation and/or rock property will be apparent to those skilled in the art in view of this disclosure.

In accordance with a preferred embodiment of the invention, each $v_{n,Burial}$ is a function of each corresponding $v_{n,Present}$ as depicted in Equation (2):

$$v_{n,Burial}=f\{v_{n,Present}\}. \tag{2}$$

Examples of suitable quantitative relationships are provided, without limitation, below. However, other suitable quantitative relationships between corresponding $v_{Burial}$ and $v_{Present}$ values will become apparent to those skilled in the art in view of this disclosure.

One embodiment provides quantitative estimates for $v_{Burial}$ by multiplying $v_{Present}$ values by a factor that produces a higher value for each $v_{n,Burial}$ compared to the respective $v_{n,Present}$. For example, each $v_{n,Present}$ value can be increased by a predetermined percentage (e.g., from about 10% to about 40%) to provide a first set of $v_{n,Burial}$ values, as long as the resulting $v_{n,Burial}$ values are less than or equal to 0.5. This example is illustrated in Equation (3):

$$v_{n,Burial\text{-}i}=(1+X_i)v_{n,Present} \tag{3}$$

where $X_i$ is a predetermined iteration value producing a set of $v_{n,Burial\text{-}i}$ values.

In the case where i=1, a set of $v_{n,Burial\text{-}1}$ values is produced.

Another embodiment provides quantitative estimates for $v_{Burial}$ by adding a factor to $v_{Present}$ values to produce a higher value for each $v_{n,Burial}$ as compared to the respective $v_{n,Present}$. For example, a suitable addition factor is illustrated in Equation (4):

$$v_{n,Burial\text{-}i}=v_{n,Present}+X_i(\mathbf{0.5}-v_{n,Present}) \tag{4}$$

The 0.5 value in Eq. (4) represents a Poisson ratio limit, above which a material increases in size under compression.

In a preferred embodiment, $v_{Burial}$ is estimated by a quantitative correlation between $v_{Burial}$ and $v_{Present}$. More preferably, the $v_{Burial}$ values are estimated by a relationship described in Equation (5):

$$X_i=\left\{\frac{v_{n,Burial-1}v_{n,Present}}{(1-v_{n,Present})(1-2v_{n,Burial-i})}\right\} \tag{5}$$

In a more preferred embodiment, $X_i$ can be represented, at least initially, by a function of a virtual present-day fracture orientation transition depth (i.e., the depth at which the orientation of induced fractures changes from substantially horizontal to substantially vertical, where $\sigma_{vert}=\sigma_{horiz\text{-}2}$) and a thickness of eroded section, as shown in Equations (6) and (7):

$$X_i=\left(\frac{Z_{Trans}}{Z_{Miss}}\right)_i \tag{6}$$

$$\left\{\frac{v_{n,Burial-i}-v_{n,Present}}{(1-v_{n,Present})(1-2v_{n,Burial-i})}\right\}=\left(\frac{Z_{Trans}}{Z_{Miss}}\right)_i \tag{7}$$

where $Z_{Trans}$ represents a fracture orientation transition depth in the formation at which induced-fracture orientation changes from substantially horizontal to substantially vertical, where $\sigma_{vert}=\sigma_{horiz\text{-}2}$; and $Z_{Miss}$ represents a thickness of an eroded section.

Eq. (7) was derived by considering a column of substantially uniform density rock to which a gravity load is applied during burial and then partially removed corresponding to the erosion. Eq. (7) assumes that the column of rock is constrained such that no lateral strains are permitted to develop. During burial, the rock is characterized by $v_{n,Burial}$, while during erosion, the rock is characterized by $v_{n,Present}$. Thus, Eq. (7) accounts for the weight of rock and the related change in rock properties during burial and after erosion. Consequently, Eq. (7) provides a reasonable estimate for a set of values, $v_{n,Burial\text{-}i}$, for a formation that has been subjected to erosion.

As illustrated in Example 1 below, the actual ($Z_{Trans}/Z_{Miss}$) value produced by the calibrated model may ultimately be greater than the virtual ($Z_{Trans}/Z_{Miss}$) value used to produce the model. One way in which such a difference can occur is when a virtual tectonic condition has been applied to the model calibration method. This is the case because, beyond causing $\sigma_{horiz\text{-}1}$ and $\sigma_{horiz\text{-}2}$ to become unequal (e.g., compare FIG. 3A and FIG. 3C, discussed below, and note separated stress plots for $\sigma_{horiz\text{-}1}$ and $\sigma_{horiz\text{-}2}$, after tectonic displacement vs. before), a tectonic event will also tend to cause $\sigma_{horiz\text{-}1}$ and $\sigma_{horiz\text{-}2}$ values to increase for a given depth in a formation. Therefore, the point at which $\sigma_{vert}=\sigma_{horiz\text{-}2}$ (i.e. $Z_{Trans}$) is shifted deeper into the formation, that is, $Z_{Trans}$ becomes greater. Accordingly, the actual ($Z_{Trans}/Z_{Miss}$) value will be greater than the virtual ($Z_{Trans}/Z_{Miss}$) value.

Nonetheless, whether or not there has been a tectonic event, one preferred method for using Eq. (6) and (7), as illustrated in Example 1, is to predetermine at least a first value, $X_1$, for producing a set of $v_{n,Burial-1}$ values by selecting one value for the ratio $(Z_{Trans}/Z_{Miss})_1$, based on knowledge of one location in a formation and to use that value for the whole formation, even though one or both of $Z_{Trans}$ and $Z_{Miss}$ are likely different at different locations in the formation. But, as noted above, where there is evidence that the formation has been subjected to a tectonic event (i.e., $\sigma_{horiz-2} \neq \sigma_{horiz-1}$), then it may be desirable to reduce the value for $X_i$ initially (i.e., $X_1$) or in a subsequent iteration.

In a preferred embodiment, $X_i$ in Eq. (5) and (7) is greater than zero and less than or equal to about 5.

Other rock properties may be required by the particular numerical modeling program used and/or to better characterize the formation of interest. Suitable rock properties include, for example without limitation, elastic stress-to-strain moduli such as E, K and G, and plastic rock properties such as friction angle, $\phi$, cohesion, c, yield strength and hardening parameters, if any. The appropriate rock properties for a selected numerical modeling program and formation, will become apparent to those skilled in the art in view of this disclosure.

For an elastic-plastic or plastic model, it may still be advantageous to use the relationships between $v_{Burial}$ and $v_{Present}$ discussed above to determine a burial stress distribution. Plastic rock properties may be used in lieu of or in addition to $v_{Burial}$ and/or $v_{Present}$ for calibrating the numerical model to present-day stress data. Appropriate estimates for plastic rock properties will become apparent to those skilled in the art in view of this disclosure.

As used herein, present-day rock properties describe rock properties for rocks in their current compacted/lithified state, even though the rock properties may be estimated using stress calibration data produced many years ago. So, "present-day" can cover a significant number of years, since on a geologic time-scale even 100 years typically produces negligible geologic changes in a formation, if any.

Rock property estimates useful for developing a model can be obtained, for example, without limitation, from well log data (e.g., sonic log data), outcrop data, seismic data, and any combination thereof. These techniques are useful for estimating $v_{Present}$, among others, preferably for each layer in the formation. The rock property estimating techniques can also be used to determine the density for each stratum in the formation of interest. Density is useful for estimating gravitational load during burial, $GL_1$, and after erosion, if any.

Also, strata thickness, $H_n$, is used in developing a modeled formation-stress analysis. As mentioned above, $H_n$ and, hence, the relative depths of each $s_n$ will typically vary throughout a formation's stratigraphy. These stratigraphic variations in $H_n$ and accordingly, in the depth of each $s_n$ are disclosed in Example 1, and depicted generally in FIG. 4.

Strata thickness can be determined, for example, from a geometric description of the formation of interest. In addition to strata thickness, the geometric description can also provide other useful information including, without limitation, elevation (e.g., relative to sea level), topography and subsurface horizons. The geometric description can be interpreted from geological mapping of the formation widely available through a geological survey agency for each country where the formation is located. For example, one source for such information in the US is the US Geological Survey. Likewise, in Canada, the Geological Survey of Canada is a source of geological mapping. Other techniques include, without limitation, seismic interpretations and well log data, which may be used instead of or in addition to the respective Geological Survey mappings.

A numerical model of the formation is constructed using at least one gravitational load condition associated with the formation and $H_n$, and $v_{Burial}$ values corresponding to each respective stratum. It will be understood by those skilled in the art that a formation's total gravitational load is typically produced by taking the sum of each stratum's respective gravitational load contribution, $gl_n$, based on the average rock density for each average rock density for each $s_n$. Also, due to stratigraphic variations that typically occur in a formation, it will be understood that the values for $H_n$ are not necessarily, and typically are not, uniform throughout the modeled formation. So, as stated above, although rock properties are often assumed to be substantially homogeneous throughout a stratum, where appropriate, in this calibration method, it is also possible to account for significant differences in rock properties within a stratum.

The method of the present invention uses a numerical modeling program adapted to performing stress calculations on multiple points in the formation to produce a modeled formation-stress analysis, FSA. Numerous 2D and 3D programs are available on the market. Numerical analysis types include, without limitation, finite element, finite difference, discrete element, distinct element, displacement discontinuity, and combinations thereof. The numerical modeling programs typically incorporate one or more constitutive models, including, without limitation, elastic, elastic-plastic, Mohr-Coulomb, Von-Mises, Tresca, Drucker-Prager, Cam-Clay, Hoek and Brown, critical state, jointed rock, and multi-laminate models. The selection of a numerical modeling program depends on, among other things, the formation of interest and the desired resolution of the stress analysis.

Preferably, the numerical modeling program is a 3D program, so that stress analysis data can be more readily used to estimate stresses at any point on the formation.

Examples of suitable numerical modeling programs using finite element analysis include, without limitation, VISAGE™ (VIPS Ltd.) and ABAQUS™ (HKS, Inc.).

In a preferred embodiment, a 3D finite element mesh is constructed depicting topography and subsurface strata, reflecting rock type and strata thickness for the formation of interest. As illustrated in Example 1 below, it may be advantageous to add at least one uninterpreted layer below the strata of interest, preferably with a flat bottom, to provide a kinematic constraint on the model when loads are applied. The rock type of the uninterpreted layer can be based, for example, without limitation, on general regional knowledge of the formation and/or the rock type of the deepest interpreted stratum. Preferably, the thickness of the uninterpreted layer is selected to be great enough that further increases in thickness of the uninterpreted layer have little to no effect on the resulting stress distribution analysis of the strata of interest in the subject formation. This and other techniques for more accurately representing the stress distribution in the formation of interest are known to those skilled in the art of modeling.

The method discussed in general below and illustrated in Example 1 is described as a two-step process. However, depending on the numerical analysis program used or the exact technique used, the steps may be transparent to the user. Alternatively, it may be useful to depict some formations, depending on their geological history, with more that two steps. And in some cases, only 1 step accounting for burial rock properties is required to produce a virgin stress distribution model.

In a one-step numerical model, a gravitational load, GL, is applied to the formation using burial rock properties. In a two-step numerical method, a stress-inducing force comprising at least a first gravitational load ($GL_1$) is applied to the formation first using burial rock properties and then, using the stress distribution produced in the $1^{st}$ step as a starting point, at least a gravitational load, which may or may not be the same as $GL_1$, is applied to a formation using present-day rock properties.

Table 1 illustrates, without limitation, examples for producing a modeled formation-stress analysis, FSA. In a one-step embodiment, $v_{n,Burial}$ values are used to produce a modeled FSA useful for an initial stress distribution for a formation that has had no significant post-burial event. In a preferred embodiment, a basic two-step approach for producing a modeled FSA can be modified, for example, without limitation, as illustrated in Table 1 to reflect geomechanical events that occurred over time in the formation.

TABLE 1

| Post-Burial | Modeling Procedure | | | | |
|---|---|---|---|---|---|
| | Burial Step | | Post-Burial Step | | Formation |
| Geomechanical event | Formation Condition | Rock Property | Formation Condition | Rock Property | Condition Description |
| No Significant Post-Burial Event | $GL_1$ | Virtual burial value (e.g., $v_{n,Burial}$) | N/A | N/A | $GL_1$ = constant |
| Erosion | $GL_1$ | Virtual burial value (e.g., $v_{n,Burial}$) | $GL_2$ | Measured value (e.g., $v_{n,Present}$) | $GL_1 > GL_2$ |
| Tectonic Displacement | $GL_1$ | Virtual burial value (e.g., $v_{n,Burial}$) | $GL_1$ and $T_1$ | Measured value (e.g., $v_{n,Present}$) | $GL_1$ = constant |
| Erosion + Tectonic Displacement | $GL_1$ | Virtual burial value (e.g., $v_{n,Burial}$) | $GL_2$ and $T_1$ | Measured value (e.g., $v_{n,Present}$) | $GL_1 > GL_2$ |

The modeling procedure described herein is not intended to be an exact replication of each geomechanical event that led to a formation's present-day stress distribution. So, as discussed above, the procedure seeks to produce one or more stress distribution scenarios for the formation of interest by using at least one variable virtual formation condition, which can be changed until the formation's present-day stress distribution is determined within the desired degree of deviation. This approach, in turn, results in a more accurate stress distribution analysis in view of each event and/or rock property believed to contribute significantly to a formation's present-day, virgin stress distribution. For example, the sediments that eventually produced the rocks in the formation were buried over the course of millions of years and each layer was compacted and lithified at different times. Also, oftentimes, tectonic displacement occurs first, resulting in uplift, followed by erosion or, perhaps, insignificant erosion.

As shown in Table 1, the $2^{nd}$ step of the modeling procedure preferably accounts for post-burial geomechanical events, such as, for example, without limitation, erosion and/or tectonic displacement.

In the case where it is believed that the formation has been subjected to erosion, the $2^{nd}$ modeling step involves applying a second gravitational load, $GL_2$, to the formation using present-day rock properties. In this case, $GL_1$ is greater than $GL_2$. Specifically, $GL_1$ represents the gravitational load produced by the weight of the present-day rocks and the estimated weight of the eroded rock. Meanwhile, $GL_2$ represents the gravitational load produced by the weight of the present-day rocks. One example for estimating the gravitational load before erosion is illustrated in Example 1. In Example 1, the Applicants were reasonably confident in the erosion depth estimate. Accordingly, this value remained constant in the Example 1 calibration. However, it is possible to introduce $GL_1$ as virtual GL value(s) in producing a modeled formation-stress analysis.

In the case where the formation is believed to have undergone a tectonic event, the $2^{nd}$ modeling step involves applying a set of virtual tectonic conditions to the formation. Generally, stress calibration data showing $\sigma_{horiz\text{-}2} \neq \sigma_{horiz\text{-}1}$ is evidence that the formation has been subjected to a tectonic event. Since, the present-day weight of rocks still applies a vertical force to the formation, the same gravitational load, $GL_1$, based on present-day rock weight, is applied at the same time as the virtual tectonic conditions.

The virtual tectonic conditions include lateral and angular displacements and constraints on one or more boundaries or sections of the model. One preferred method is to apply a lateral displacement from one side, while constraining the modeled formation on the opposing side. Again, the Applicants have found that, rather than attempting to mimic or estimate the exact tectonic displacement, a virtual tectonic displacement can be used to more accurately produce a modeled formation-stress analysis. So, although a virtual tectonic displacement may not accurately reflect the strain that occurred over geologic time, it more accurately produces the resulting stress distribution conforming, within the desired degree of certainty, to the formation's present-day stress distribution. Example 1 illustrates how a model can be calibrated using a virtual tectonic displacement as a variable in initial calibration runs, along with an erosion condition.

In the case where the formation is believed to have undergone both tectonic displacement and erosion, the $2^{nd}$ modeling step involves applying both $GL_2$ and tectonic conditions, as discussed above. Example 1 illustrates a modeling procedure for a formation subjected to both erosion, albeit as an estimate of actual (i.e., known) erosion and virtual tectonic conditions. However, virtual erosion conditions could also be used in the procedure, with virtual or actual (i.e., known) tectonic conditions.

Once a modeled $FSA_i$ is produced, a set i of stress profiles for at least one location, $L_f$, $SP_{i,Lf}$, are extracted and compared to $L_f$ stress calibration data from the respective location, $L_f$. Examples of types of stress tests for producing stress calibration data include, without limitation, fracture tests, formation integrity tests, mini-frac tests, fracture orientation transition depth data, borehole ellipticity and breakout data.

The types of stress tests and amounts (e.g., number of data points obtained for each type of test) of stress calibration data suitable for comparing to stress profiles will depend substantially on (i) the intended application for the calibrated formation stress distribution model and (ii) the desired degree of resolution, respectively. While it may be possible to calibrate a model using only one type of stress calibration data, generally, the versatility and resolution of the model will improve with increased types and amount of stress calibration data, respectively. Also, as illustrated in Example 1, different types of data can improve the certainty with which a proposed model of the formation's stress distribution is calibrated to the formation's true present-day, virgin stress distribution. It will become apparent to those skilled in the art, in view of this disclosure, how to select the type(s) and amount of data suitable for calibrating a formation stress distribution model in view of its intended application(s).

Preferably, the stress calibration data is produced from a formation having a virgin stress distribution. However, in the case where a stress-altering man-induced activity has occurred at a first location, $L_1$, stress calibration data may nonetheless be available from tests conducted prior to the man-induced activity. But, in the case where suitable pre-man-induced-activity stress calibration data is not available for $L_1$, it is preferable to obtain suitable data from a second location, $L_2$, in the formation where the stress distribution was not materially affected by the man-induced activity. Once the model is calibrated for the virgin stress distribution, man-induced activities at $L_1$ can be accounted for to bring the model to the present-day stress distribution. Then the model can be used to predict the effects on stress distribution by proposed further man-induced activities at $L_1$, $L_2$, and/or any other location, $L_{3-m}$, in the formation.

A degree of deviation, $D_i$, between $SP_{i,Lf}$ and $L_f$ stress calibration data is determined. $D_i$ may be determined quantitatively or qualitatively, in a manner known to those skilled in that art, and represents a difference between measured $L_f$ stress calibration data at a given depth and the modeled $SP_{i,Lf}$ corresponding to that depth. If the degree of deviation between the stress profiles and the stress calibration data is acceptable for the desired application, the model is calibrated and may be used in a variety of applications. If the degree of deviation is not acceptable for the formation-stress analysis desired, then the modeling steps are repeated one or more times by changing $v_{Burial}$, tectonic displacement, whether virtual or actual, $GL_1$, whether virtual or actual, and/or any other variable formation condition considered relevant to producing the formation's present-day, virgin stress distribution.

The calibrated model produced by the method of the invention can be used in a variety of applications including, without limitation, estimating stress in other locations of the formation, estimating fracture pressure, estimating fracture propagation (e.g., orientation, direction, magnitude), and combinations thereof. Also, the calibrated formation stress distribution can be used in other models for modeling effects of man-induced activities including, without limitation subsidence, fissure formation, and combinations thereof.

Figure 1B:
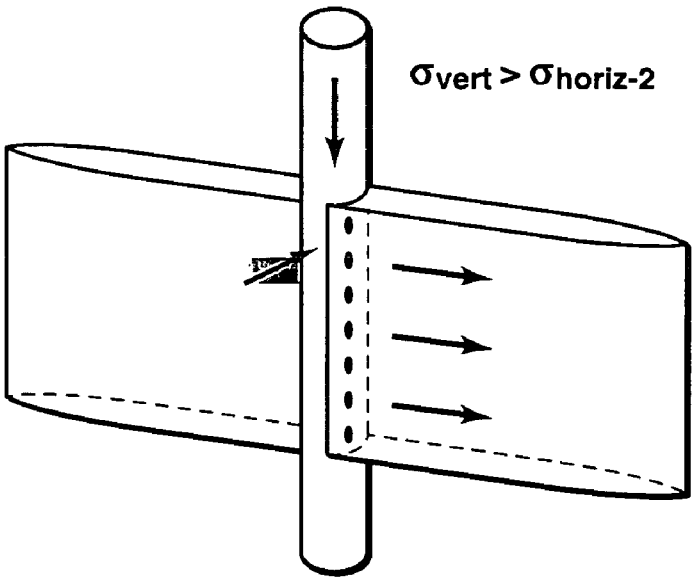
FIG. 1B (PRIOR ART)
FIG. 1B is a schematic representation of a vertical fracture.

One application of the calibrated model, which is illustrated in Example 2, is estimating fracture orientation transition depth. In particular, the method of the present invention produces a modeled formation-stress analysis that can be used to determine whether induced fractures will tend to be oriented horizontally or vertically. A horizontal fracture is illustrated schematically in FIG. 1A while a vertical fracture is illustrated in FIG. 1B. Thus, in one particular embodiment, the fracture orientation transition depth represents depths above which $\sigma_{horiz\text{-}2}>\sigma_{vert}$ and below which $\sigma_{vert}>\sigma_{horiz\text{-}2}$.

Figure 2:
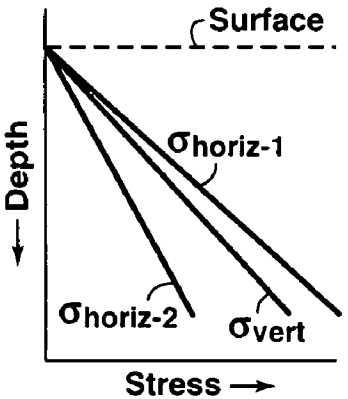
FIG. 2 (PRIOR ART)
FIG. 2 is a graphical representation of a stress distribution analysis produced by conventional methods where $\sigma_{vert}=\sigma_{horiz-2}=\sigma_{horiz-1}=0$ at the top surface of a formation.

Applying the claimed invention to estimating fracture orientation transition depth is a particularly notable application because conventional methods fail to account for the effects of burial rock properties on the formation's stress distribution. Moreover, by assuming that each horizontal stress is a multiplier of the vertical stress, each conventional model produces a zero surface stress, where $\sigma_{vert}=\sigma_{horiz\text{-}2}=\sigma_{horiz\text{-}1}=0$ at the surface, and thus are intrinsically unable to account for a fracture orientation transition depth because of the assumption tying (by some multiplier) $\sigma_{horiz\text{-}1}$ and $\sigma_{horiz\text{-}2}$ values to a $\sigma_{vert}$ value. This conventional case is illustrated graphically in FIG. 2.

In order for the conventional method to account for fractures that will generally be oriented horizontally, both horizontal stress multipliers must be greater than one. Likewise, induced fractures will generally be oriented vertically when at least one horizontal stress multiplier is less than one. But the conventional methods do not provide a means for changing the horizontal stress multipliers to account for both horizontal and vertical fracture orientations in the same formation location, albeit at different depths.

By accounting for the stress distribution using both burial and present-day rock properties, the present Applicants found that a modeled formation-stress analysis produced according to their method can provide estimates for fracture orientation transition depths, above which $\sigma_{horiz\text{-}2}>\sigma_{vert}$ and below which $\sigma_{vert}>\sigma_{horiz\text{-}2}$.

Figure 3A:
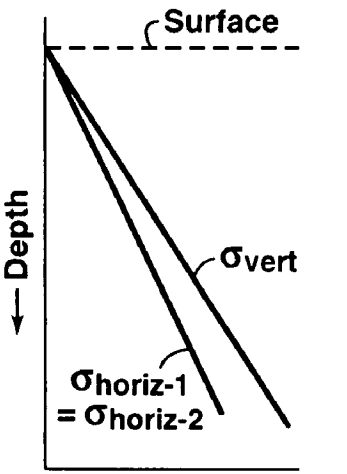
FIG. 3A is a graphical representation of a hypothetical example stress distribution analysis using a calibrated model of a formation according to the claimed method, prior to applying any erosion or tectonic event(s) to a model of the formation.
Figure 3B:
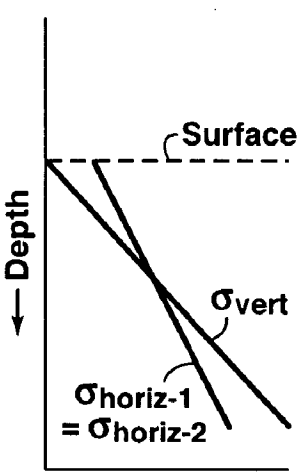
FIG. 3B is a graphical representation of a hypothetical example stress distribution analysis using a calibrated model of a formation according to the claimed method, after applying only an erosion event to a model of the formation.

Using a model of a formation's present-day, virgin stress distribution, calibrated in accordance with the method of the Applicant's invention, the effect of burial and erosion on principal stresses is generally depicted in hypothetical examples in FIG. 3A and FIG. 3B. In particular, during burial, the principal stresses at the surface are equal to zero. This burial stress distribution is illustrated hypothetically in FIG. 3A. In the example illustrated in FIG. 3A and FIG. 3B, $\sigma_{horiz\text{-}1}$ and $\sigma_{horiz\text{-}2}$ are equal. Using this burial stress distribution as a starting point, when a stress analysis is produced for a formation where it is believed there has been erosion, $\sigma_{vert}$ equals zero at the surface, while the principal horizontal stresses, $\sigma_{horiz\text{-}1}$ and $\sigma_{horiz\text{-}2}$ are equal and greater than zero, and therefore greater than $\sigma_{vert}$ at the surface, as shown hypothetically in FIG. 3B.

One reason the principal horizontal stresses are greater than zero at the surface after erosion is because the horizontal stresses that were produced during burial are not completely relieved after erosion. As shown in FIG. 3B, the slope of the $\sigma_{horiz\text{-}2}$ stress profile established during burial (i.e., FIG. 3A) remained substantially unchanged after erosion.

On the other hand, since $\sigma_{vert}$ is largely a result of gravitational load, $\sigma_{vert}$ is substantially completely relieved at the surface after erosion. Deeper in the formation, $\sigma_{vert}$ becomes greater than $\sigma_{horiz\text{-}1}$ and $\sigma_{horiz\text{-}2}$. So, at some point there is a fracture orientation transition depth, where the fracture orientation trend changes from substantially horizontal to substantially vertical. It will be understood by those skilled in the art that, depending on attributes of a formation or a particular location in a formation and the orientation of the principal stresses, it is possible for fractures to be oriented at an angle between substantially vertical and substantially horizontal. Nonetheless, for ease of discussion and in view of the definition for principal stress provided herein, fractures will be referred to as being oriented substantially horizontal or substantially vertical.

Figure 3C:
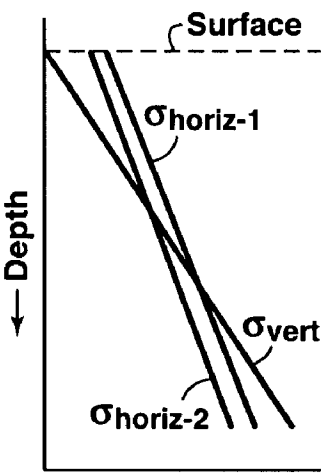
FIG. 3C is a graphical representation of a hypothetical example stress distribution analysis using a calibrated model of a formation according to the claimed method, after applying only a tectonic event to a model of the formation.

Also, using a model of a formation's virgin stress distribution, calibrated in accordance with the method of the Applicant's invention, the before and after effect of a tectonic event on principal stresses is hypothetically depicted by comparing FIG. 3A and FIG. 3C, respectively. Again, using the FIG. 3A burial stress distribution as a starting point, when a stress analysis is produced for a formation where it is believed there has been a tectonic event, $\sigma_{vert}$ equals zero at the surface, while both $\sigma_{horiz\text{-}1}$ and $\sigma_{horiz\text{-}2}$ are greater than zero, and therefore greater than $\sigma_{vert}$ at the surface, as shown hypothetically in FIG. 3C.

One reason the principal horizontal stresses are greater than zero at the surface after a tectonic event is because the lateral force induced by tectonic displacement is generally greater than the vertical force, if any. As discussed above with respect to FIG. 3B, the slope of the $\sigma_{horiz\text{-}2}$ and $\sigma_{horiz\text{-}1}$ stress profiles established during burial (i.e., depicted hypothetically in FIG. 3A) remained substantially unchanged after erosion. However, as shown in FIG. 3C, the lateral force applied to the formation by the tectonic event shifted the $\sigma_{horiz\text{-}2}$ stress profile to a higher set of values (vs. its set of values before the tectonic event, see, e.g., FIG. 3A), while maintaining substantially the same slope. Also, as depicted in FIG. 3C, the $\sigma_{horiz\text{-}1}$ is increased to a greater extent than the $\sigma_{horiz\text{-}2}$. Thus, $\sigma_{horiz\text{-}1}$ is no longer equal to $\sigma_{horiz\text{-}2}$. This is consistent with the expected effect of tectonics observed by those skilled in the art. Meanwhile, $\sigma_{vert}$ remains relatively unchanged since $\sigma_{vert}$ is largely a result of gravitational load. As in the case of erosion, $\sigma_{vert}$ becomes greater than $\sigma_{horiz\text{-}2}$ deeper in the formation. So, again, at some point there is a fracture orientation transition depth, where the fracture orientation trend changes from substantially horizontal to substantially vertical.

Figure 3D:
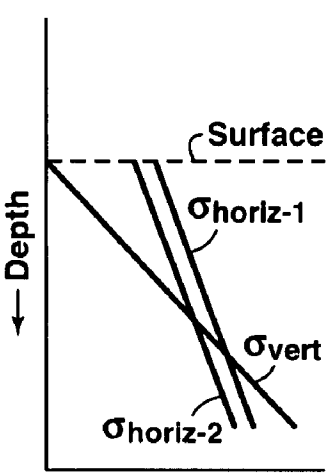
FIG. 3D is a graphical representation of a hypothetical example stress distribution analysis using a calibrated model of a formation according to the claimed method, after applying both an erosion event and a tectonic event to a model of the formation.

A hypothetical stress profile is shown in FIG. 3D for a formation where it is believed there has been both erosion and tectonics. As discussed above with respect to FIG. 3B and FIG. 3C, both events cause the fracture orientation transition depth to move deeper in the formation accordingly.

Again, the stress distribution analyses illustrated in FIG. 3B, FIG. 3C and FIG. 3D are not possible using conventional methods that assume each horizontal stress is a multiplier of the vertical stress, because each conventional model produces zero stress at the surface.

EXAMPLES

The following non-limiting examples of embodiments of the present invention that may be used as claimed herein are provided for illustrative purposes only. Because the information used in developing and calibrating the model and the results from using the calibrated model is proprietary business information, the location and outline of the formation, the stratigraphy, elevation and stress magnitudes have been de-identified for the purposes of the examples. Nonetheless, one preferred embodiment of the formation stress model calibration procedure, and the model's subsequent application, discussed below, is based on a particular formation of commercial interest and stress calibration data obtained for that formation, which includes some data generated many years before the calibration procedure was performed (e.g., about 40 years before).

Example 1

Figure 4:
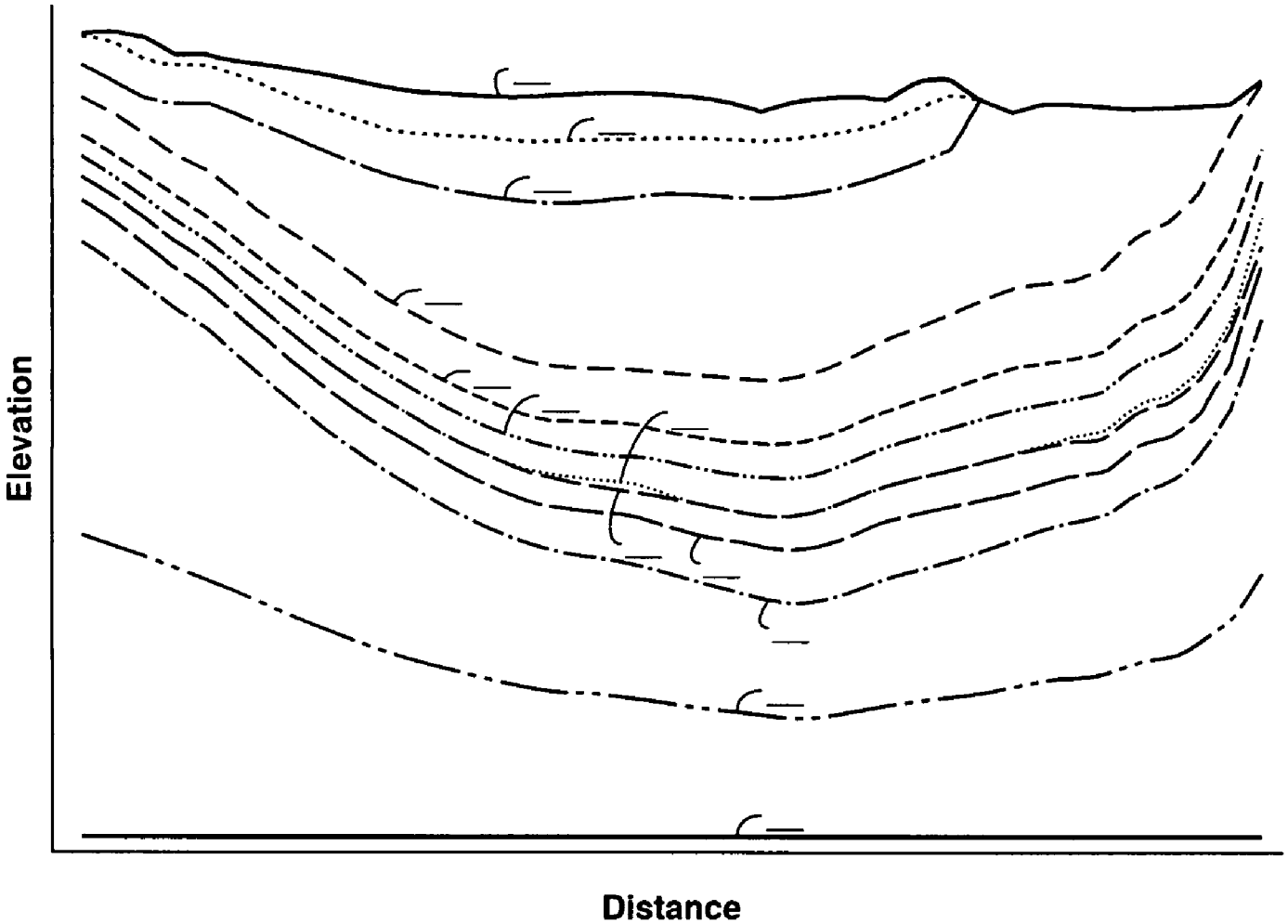
FIG. 4 is a graphical representation of a cross-section of the topography and sub-surface horizons for the formation of interest used in Example 1.

The topography and nine subsurface horizons (i.e., the top of each strata) for the formation of interest were obtained from company data and published interpretations of the region from the US Geological Survey. FIG. 4 is a graphical representation of one structural cross-section of the formation. The top line, labeled "Topo," represents the topography elevation along the cross-section. The nine subsurface horizons for nine strata in the formation are labeled Horizon 2 through Horizon 10.

To provide a flat bottom surface, on which kinematic constraints could be applied in the numerical modeling, two additional strata were added. The horizon of the near-bottom stratum is labeled Horizon 11, while the flat bottom horizon of the bottom stratum is labeled "Bottom".

The gross lithology for each strata was interpreted from well log data and outcrop studies. The interpreted gross lithology for each stratum is described in terms of compositional percentage of end-member lithologies in Table 2. For convenience, the subsurface horizons from FIG. 4 are inserted to show the relative positions of layers and their respective horizons.

The lithology for Layer 10, which was added for numerical modeling purposes, was based on the lithology for Layer 9 and regional knowledge that Layer 10 had a higher shale content. Layer 11 was assigned the same lithology as Layer 10.

The lithology interpretations were then used to estimate elastic rock mechanical properties, namely, Young's modulus, $E_{Present}$, and Poisson ratio, $v_{Present}$, for each strata. These elastic rock properties are listed in Table 2. The estimated rock mechanical properties describe each strata in its current lithified state.

In this example, $E_{Present}$, $v_{Present}$ and density were determined by averaging estimates for each end-member lithology.

TABLE 2

| Layer | Lithology SS = Sandstone, SH = Shale, SILT = Siltstone, CBM = Carbonate Mud Stone | $E_{Present}$ (psi × $10^6$) | $v_{Present}$ (—) | $v_{Burial\text{-}1}$ (—) | $v_{Burial\text{-}2}$ (—) | Density (lb/ft$^3$) |
|---|---|---|---|---|---|---|
| | | Topography | | | | |
| 1 | 25% SS, 25% SH, 10% SILT, 40% CBM | 1.72 | 0.2538 | 0.3104 | 0.3299 | 117.41 |
| | | Horizon 2 | | | | |
| 2 | 100% SH | 2.30 | 0.2000 | 0.2727 | 0.2973 | 137.34 |
| | | Horizon 3 | | | | |
| 3 | 15% SS, 85% SH | 2.24 | 0.2639 | 0.3176 | 0.3362 | 141.78 |
| | | Horizon 4 | | | | |
| 4 | 65% SS, 25% SH, 10% SILT | 4.26 | 0.2288 | 0.2928 | 0.3146 | 146.44 |

TABLE 2-continued

| Layer | Lithology SS = Sandstone, SH = Shale, SILT = Siltstone, CBM = Carbonate Mud Stone | $E_{Present}$ (psi × $10^6$) | $v_{Present}$ (—) | $v_{Burial-1}$ (—) | $v_{Burial-2}$ (—) | Density (lb/ft$^3$) |
|---|---|---|---|---|---|---|
| | | Horizon 5 | | | | |
| 5 | 40% SS, 45% SH, 10% SILT, 5% Coal | 3.74 | 0.2651 | 0.3185 | 0.3370 | 147.16 |
| | | Horizon 6 | | | | |
| 6 | 35% SS, 30% SH, 10% SILT, 25% Coal | 3.05 | 0.3188 | 0.3576 | 0.3714 | 133.32 |
| | | Horizon 7 | | | | |
| 7 | 35% SS, 50% SH, 10% SILT, 5% Coal | 3.95 | 0.2672 | 0.3200 | 0.3383 | 149.74 |
| | | Horizon 8 | | | | |
| 8 | 35% SS, 60% SH, 5% SILT | 4.22 | 0.2516 | 0.3089 | 0.3286 | 154.45 |
| | | Horizon 9 | | | | |
| 9 | 10% SS, 80% SH, 5% SILT, 5% CBM | 3.93 | 0.2644 | 0.3180 | 0.3366 | 156.49 |
| | | Horizon 10 | | | | |
| 10 | 5% SS, 85% SH, 5% Silt, 5% CBM | 4.26 | 0.2666 | 0.3195 | 0.3379 | 159.39 |
| | | Horizon 11 | | | | |
| 11 | 5% SS, 85% SH, 5% SILT, 5% CBM | 4.84 | 0.2664 | 0.3194 | 0.3378 | 162.40 |
| | | Bottom | | | | |

Certain pre-existing stress calibration data was available for the formation of interest. And fortunately, this stress data was produced at a time before the formation's stress distribution was converted to a non-virgin stress state (i.e., before any material stress-altering man-induced event(s) occurred in the formation). From this data, the Applicants were able to generally conclude that $\sigma_{horiz-1} \neq \sigma_{horiz-2}$ and, accordingly, that the formation had been subjected to one or more tectonic events.

As discussed below, a basin-wide estimate of the amount of erosion was made based on available data for one location, $L_1$. The basin-wide estimate was held constant during model calibration. Thus, the variables that were changed during calibration were the virtual burial Poisson ratio values and the virtual tectonic displacement.

To begin calibration, four modeling runs were performed using 2 sets of virtual burial Poisson ratio values, $v_{Burial}$, and 2 degrees of virtual tectonic displacement, as discussed more fully below. The Applicants initially expected to perform at least one subsequent stress analysis, based on their review of the initial four analyses. However, as discussed below, one of the four initial analyses was within an acceptable degree of deviation from available data. Accordingly, the model was calibrated by one of the four sets of formation condition scenarios proposed for calibrating the model of the formation. Also, in this instance, these independent sets of formation condition scenarios were run contemporaneously to reduce time delays arising from turn-around time for each modeling run. In turn, each modeling run generated the stress profiles used for comparing to the stress calibration data.

Rock behavior during burial was estimated using the relationship described in Equation (8):

$$\frac{Z_{Trans}}{Z_{Miss}} = \left\{ \frac{v_{Burial} = v_{Present}}{(1 - v_{Present})(1 - 2v_{Burial})} \right\} \tag{8}$$

For initial calibration, 2 values for the ratio ($Z_{Trans}/Z_{Miss}$) were selected, so that the corresponding virtual burial Poisson values could be calculated from Eq. (8). Specifically, the first set of virtual burial Poisson ratio, $v_{Burial-1}$, values was calculated using ($Z_{Trans}/Z_{Miss}$)=0.2, while ($Z_{Trans}/Z_{Miss}$)=0.3 was used for calculating the second set of burial Poisson ratio, $v_{Burial-2}$, values. The values for $v_{Burial-1}$ and $v_{Burial-2}$ for each layer are shown in Table 2.

In this case, $E_{Present}$ was assumed to have remained substantially unchanged from burial to present-day conditions. The Applicants believe this is a reasonable assumption because, in the subject formation, changes in v were believed to be more significant in affecting the formation's present-day virgin stress distribution than E.

As noted above, the formation of interest had been subjected to tectonics and erosion. Earlier company data for $L_1$ in the formation showed approximately 3,000 ft. of erosion over the last 10 million years, based on vitrinite reflectance and apatite fission track data. The current elevation at $L_1$ is x feet. So, prior to erosion, the elevation at $L_1$ was (x+3,000) ft.

Assuming (1) a uniform elevation prior to erosion, and (2) the current topography is entirely the result of erosion, the amount of erosion could be estimated for any point in the formation by taking the difference between the current elevation at that point and (x+3,000) ft. The Applicants acknowledge that this is a simplification of actual geological history. However, the Applicants believe that the approximation likely captures variations in erosion within an acceptable degree of deviation.

As discussed above, stress calibration data available to the Applicants provided early evidence that the subject formation had undergone one or more tectonic events. Specifically, stress data at one location in the formation showed $\sigma_{horiz-2} \neq \sigma_{horiz-1}$. The effects of tectonic displacement were estimated by applying virtual displacement boundary conditions to the model. Specifically, in modeling runs 1-1 and 2-1, a lateral displacement of 20 m was imposed from the eastern boundary of the model, while the model was constrained on the western boundary. And, in modeling runs 1-2 and 2-2, the lateral displacement was 40 m. The Applicants acknowledge that the strain resulting from the virtual tectonic displacement may not reflect the strain that occurred over geologic time. However, a virtual lateral (i.e., tectonic displacement, which ultimately helps calibrate the model, contributes to a set of formation conditions that produces the formation's present-day, virgin stress distribution.

Stress analysis of the formation of interest was performed using VISAGE™ (version 8.9.1.20), a finite element numerical analysis program from VIPS Ltd. The modeling procedure was conducted in two steps.

The Poisson ratio values and applied stress-inducing forces for each modeling step are summarized in Table 3.

TABLE 3

| | Burial Formation Conditions | | | Present-Day Formation Conditions | | |
|---|---|---|---|---|---|---|
| Run | Gravitational Load | Tectonic Displacement | Rock Properties per stratum, $s_n$ | Gravitational Load | Tectonic Displacement | Rock Properties per stratum, $s_n$ |
| 1-1 | Present-day | 0 | $v_{n,Burial\text{-}1}$ | Present-day | 20 m | $v_{n,Present}$ |
| 1-2 | rock weight + estimated | 0 | $v_{n,Burial\text{-}1}$ | rock weight | 40 m | $v_{n,Present}$ |
| 2-1 | eroded rock | 0 | $v_{n,Burial\text{-}2}$ | | 20 m | $v_{n,Present}$ |
| 2-2 | weight | 0 | $v_{n,Burial\text{-}2}$ | | 40 m | $v_{n,Present}$ |

First, using the corresponding $v_{Burial}$, $E_{Present}$ and density values for each stratum, $s_n$ from Table 2, the model was loaded with a 1st gravitational load represented by the weight of the current formation strata and the estimated weight of the eroded depth. As noted above, the eroded depth at $L_1$ in the formation was 3,000 ft. The weight of the eroded depth was determined using the density for Layer 1 (see Table 2).

As a result of the first step, the model produced a 1st stress distribution. The second modeling step was then performed using the 1st stress distribution as a starting point.

In the second step, both a gravitational load and a virtual lateral displacement were applied to the model. The rock properties used in the second step were the $v_{Present}$, $E_{Present}$ and density values from Table 2.

The gravitational load, however, was less than the gravitational load used in the first step. Specifically, in the second step, the gravitational load represented the weight of the current formation strata, after erosion. As noted above, for the initial calibration, the two values selected for virtual lateral displacement were 20 meters and 40 meters.

For each of these model runs, stress profiles were extracted for four locations in the formation, namely $L_l$, $L_2$, $L_3$ and $L_4$. The principal normal stresses, $\sigma_{vert}$, $\sigma_{horiz\text{-}1}$ and $\sigma_{horiz\text{-}2}$, were plotted against elevation (relative to sea level) for each of the four calibration runs at each of the four locations. The principal normal stresses for each location and each run are depicted graphically in FIGS. 5A and 5B, in which each $\sigma_{vert}$ is depicted with a solid line, each $\sigma_{horiz\text{-}2}$ is depicted by a dotted line and each $\sigma_{horiz\text{-}1}$is depicted by a dashed line.

For convenience, the position of the subsurface horizons in the model are shown by tick marks along the vertical line representing zero stress. The top tick mark corresponds to the topographical elevation, while the remaining tick marks correspond to the subsurface Horizons 2-10.

As shown in Table 2, the Poisson ratio values were greatest in Layer 6 ($v_{Present}$=0.32, $v_{Burial\text{-}1}$=0.36, $v_{Burial\text{-}2}$=0.37), as compared with the remaining layers. The higher Poisson ratios resulted in an increase in $\sigma_{horiz\text{-}2}$ and, therefore, an increase in fracture pressure for Layer 6. The increased $\sigma_{horiz\text{-}2}$ is illustrated by the inflection points in each $\sigma_{horiz\text{-}2}$ plot, and at least to some degree in each $\sigma_{horiz\text{-}1}$ plot, in FIGS. 5A and 5B.

Figure 5A:
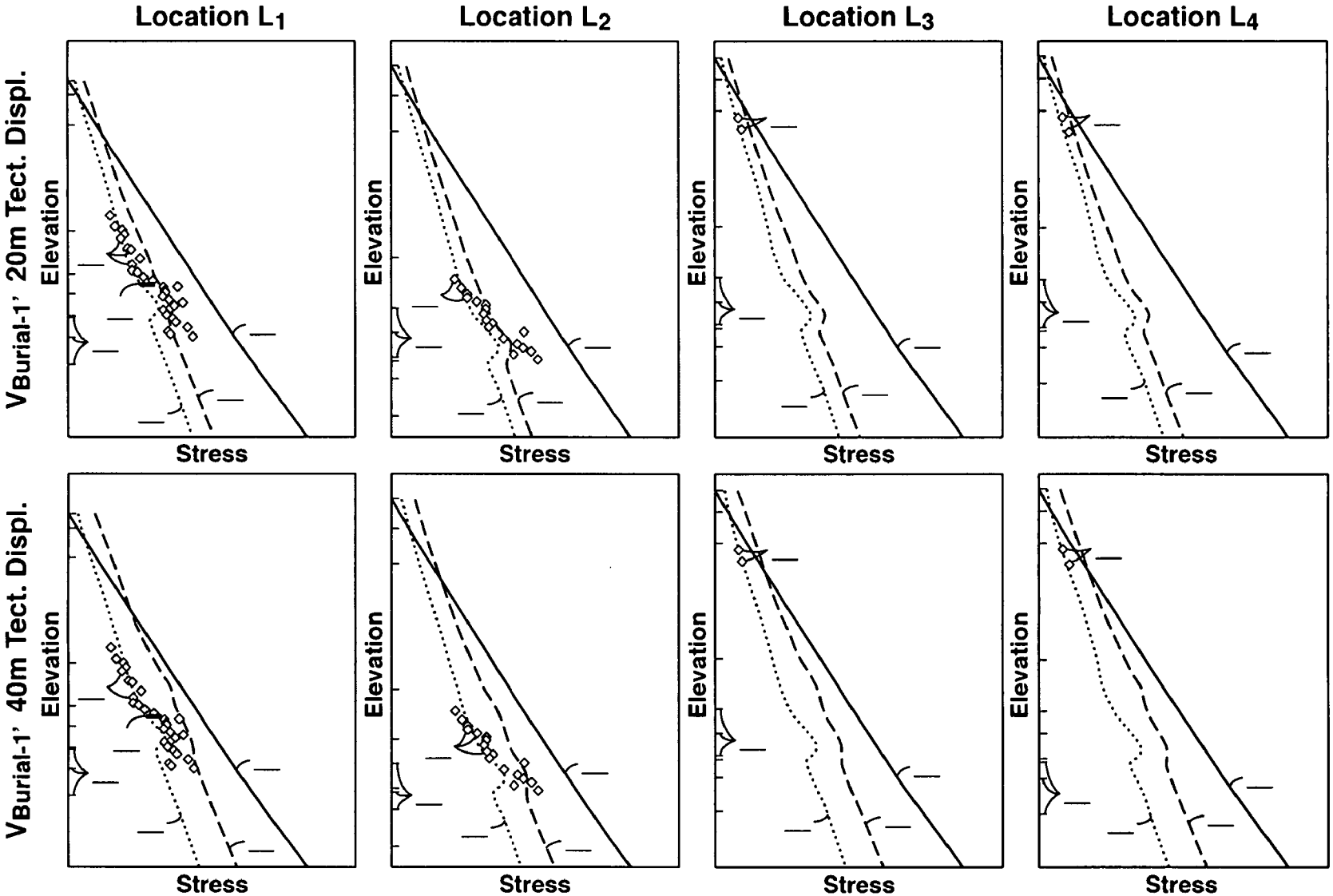
FIGS. 5A and 5B is a graphical representation of principal stresses versus elevation, plotted against stress calibration data obtained for four different area locations, identified as $L_1$, $L_2$, $L_3$ and $L_4$, respectively, in the formation of interest, as produced by four modeling runs described in Example 1, each modeling run based, in part, on an independent set of virtual formation conditions using different $v_{Burial}$ values, $v_{Burial-1}$ and $v_{Burial-2}$, and degrees of tectonic displacement, 20 m and 40 m.
Figure 5B:
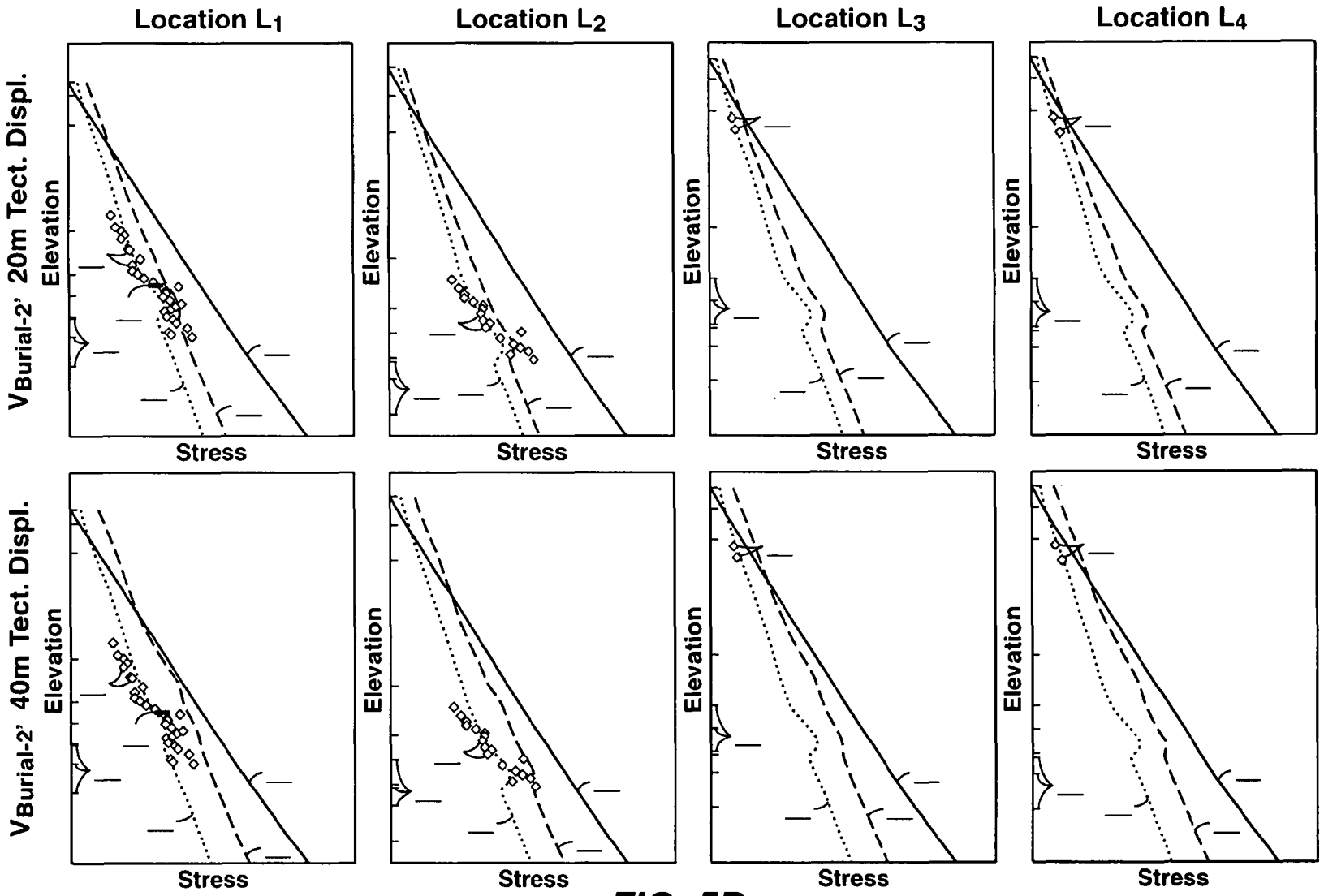

As shown in each of the graphs in FIGS. 5A and 5B, each $\sigma_{horiz\text{-}1}$ plot is substantially parallel to and shifted to the right of each $\sigma_{horiz\text{-}2}$ plot. As expected, the amount of shift is greater for the higher virtual tectonic displacement (40m), as compared with the lower virtual tectonic displacement (20m).

Calibration data were over-plotted on the stress-elevation plots in FIGS. 5A and 5B for comparing to the model predictions. In this preferred case, three types of field stress test data were available for calibrating the model. These data provided measured values for (1) $\sigma_{horiz\text{-}2}$ for four locations at a several depths; (2) difference between $\sigma_{horiz}$ and $\sigma_{horiz\text{-}1}$ one location and one depth; and (3) fracture orientation transition depth for one location. As discussed above, these different types of stress tests and the amount of available stress calibration data increased the versatility and resolution of the calibrated model. And, as illustrated in FIGS. 5A and. 5B, the degree of certainty with which the model of the formation's stress distribution was calibrated to the formation's true present-day, virgin stress distribution was also enhanced by using the different types of stress test calibration data.

First, a number of fracture tests were conducted at different elevations at $L_l$, $L_2$, $L_3$ and $L_4$. The fracture tests provide stress calibration data for comparing the $\sigma_{horiz\text{-}2}$ profile generated by the model at different elevations. These fracture test data are depicted by diamonds in each of the four graphs for each location. For ideal calibration with respect to this stress measurement parameter, all the diamonds would fall along the line representing $\sigma_{horiz\text{-}2}$.

Second, a series of fracturing tests were conducted at $L_1$ to identify the transition between horizontal and vertical fracturing. The double horizontal line in each of the $L_1$ graphs between the tick marks for Horizons 2 and 3 indicate the upper and lower bounds for the horizontal-vertical transition as determined by the fracture tests. For ideal calibration with respect to this stress measurement parameter, the $\sigma_{horiz\text{-}2}$ and $\sigma_{vert}$ plots should cross within the double horizontal Transition line.

Third, borehole ellipticity and breakout data was available for Layer 5 in $L_1$. Interpreting the ellipticity and breakout data provide an estimate of the difference between the $\sigma_{horiz\text{-}1}$, and $\sigma^{horiz\text{-}2}$ plots. The difference in stress is represented by the horizontal bar shown in Layer 5 of each $L_1$ graph. For ideal calibration with respect to this stress measurement parameter, the delta-ah horizontal bar would exactly or near-exactly span the gap between the two horizontal stresses.

From the comparisons, model run 2-1, using $v_{Burial\text{-}2}$ and 20 m tectonic displacement, was selected as matching the calibration data as completely as can be expected for a model of this resolution. As a result, model run 2-1 was selected as the calibrated basin-scale model.

As noted above, the estimated erosion depth (i.e., $Z_{miss}$) at $L_1$ was 3,000 ft. Meanwhile, the calibrated model indicates that the fracture orientation transition depth (i.e., $Z_{Trans}$) at $L_1$ was about 1,200 ft. Accordingly, the actual ($Z_{Trans}/Z_{Miss}$) value was about 0.4. The difference between the actual ($Z_{Trans}/Z_{Miss}$)=0.4 and the calibrated virtual value for ($Z_{Trans}/Z_{Miss}$)=0.3 is due to the increase in $Z_{Trans}$ resulting from tectonic displacement.

Example 2

The calibrated model from Example 1 was used to illustrate one example application. In particular, this example was conducted to estimate the fracture orientation transition elevation for the entire formation of interest. Specifically, above the fracture orientation transition elevation, induced fractures will tend to be substantially horizontal in orientation, while below the transition elevation, induced fractures will tend to be oriented substantially vertically. The formation-wide transition elevation estimate includes the effects of topography, tectonics, and recent erosion. The transition elevation estimates are useful for assessing, at any point of interest in the formation, whether the formation's stress state, at that point, is more likely to favor either a substantially horizontal or vertical fracture orientation.

Figure 6:
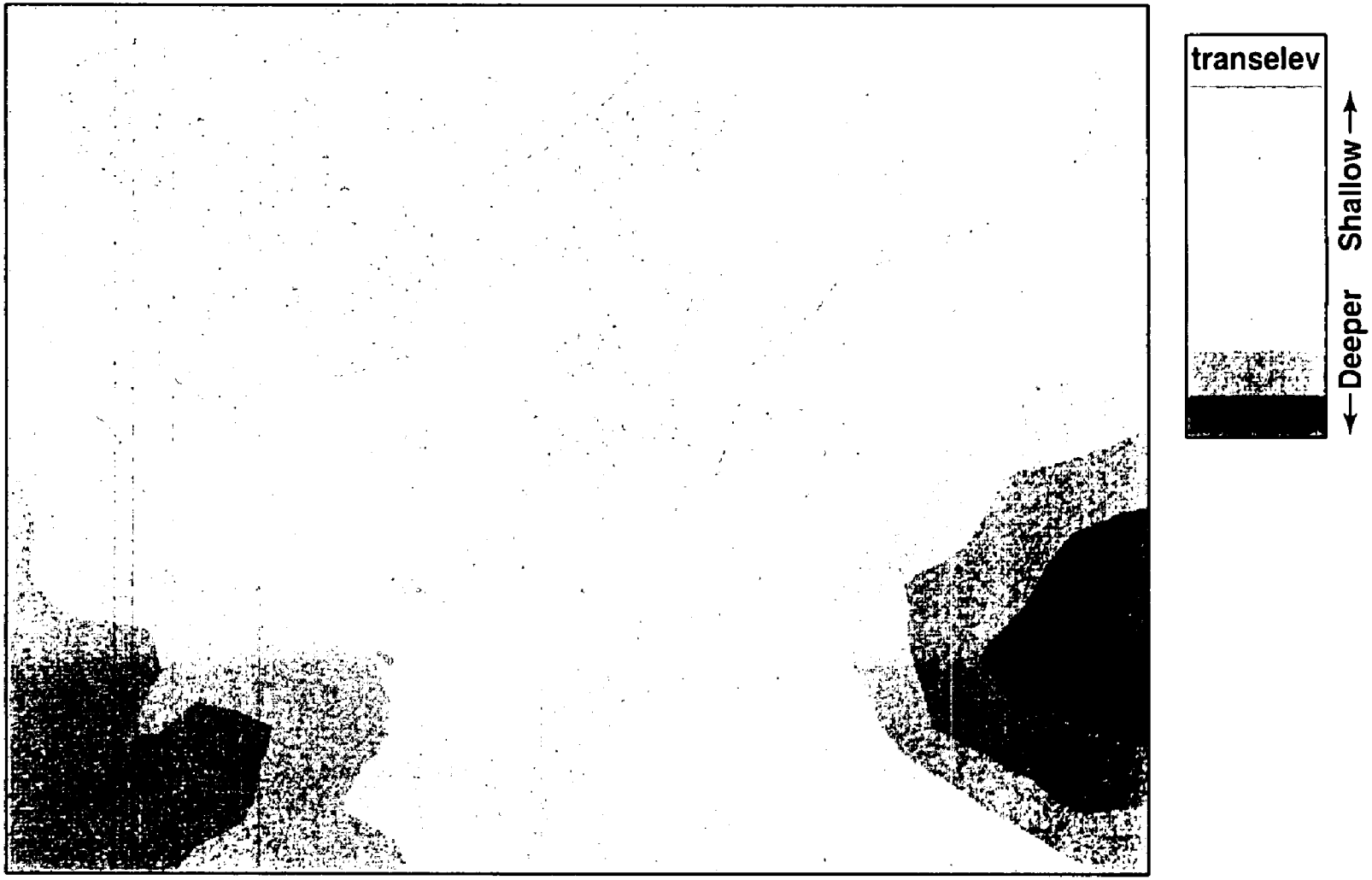
FIG. 6 is an illustration of one application, as described in Example 2, for using a numerical model as calibrated in Example 1, graphically showing fracture orientation transition elevations throughout the Example 1 formation, above which elevations, the formation is expected to more likely fracture substantially horizontally and below which elevations, a formation is expected to more likely fracture substantially vertically.

Stress profiles were extracted from the modeled formation-stress analysis. The elevations where values for $\sigma_{vert}$ and $\sigma_{horiz-2}$ were equal were recorded. The elevations were used to produce FIG. 6, which illustrates the fracture orientation transition elevations for the formation. Induced fractures at elevations above the fracture orientation transition elevation are expected to more likely fracture in a substantially horizontal orientation, while fractures at elevations below the fracture orientation transition elevation are expected to more likely fracture in a substantially vertical orientation.

Preferred processes for practicing and using the invention have been described. It will be understood that the foregoing is illustrative only and that other embodiments of the process can be employed without departing from the true scope of the invention defined in the following claims.

We claim:

1. A method for producing a substantially calibrated numerical model, which can be used for calculating a stress on any point in a formation, the method comprising:

a. predetermining a number, n, of strata suitable for modeling the formation, wherein n=a whole integer≧1 and $s_n$ independently designates each stratum, respectively;

b. predetermining for each $s_n$ a corresponding thickness, $H_n$, and a corresponding present-day Poisson ratio, $v_{n,Present}$;

c. obtaining stress calibration data $L_f$, for at least one location in the formation, wherein for a first location in the formation, $L_f$=$L_1$ stress calibration data;

d. predetermining at least one set, i, of values comprising a burial Poisson ratio corresponding to each $s_n$, $v_{n,Burial-i}$, wherein each $v_{n,Burial-i}$≦0.5 and each $v_{n,Burial-i}$> $v_{n,Present}$, wherein for i=1 a first set of values for burial Poisson ratio, $v_{n,Burial-1}$, is predetermined;

e. predetermining at least a 1st gravitational load, $GL_1$, associated with the formation;

f. using at least each of the $GL_1$, the $H_n$ and the $v_{n,Burial-i}$ values to perform stress calculations with a numerical modeling program on multiple points in the formation so that at least one modeled formation-stress analysis, $FSA_i$, can be produced, wherein for i=1 a first modeled formation-stress analysis, $FSA_1$, is produced with the numerical modeling program;

g. producing from each $FSA_i$a corresponding set, i, of modeled stress profiles for $L_f$, $SP_{i,Lf}$, having at least one principal stress, wherein for i=1 and $L_1$, a first set of modeled stress profiles, $SP_{1,L1}$, is produced;

h. comparing each $SP_{i,Lf}$ to the $L_f$ stress calibration data, wherein for i=1 and $L_1$, $SP_{1,L1}$ is compared to the $L_1$ stress calibration data;

i. determining a degree of deviation, $D_i$, from comparing, respectively, each of $SP_{i,Lf}$ and the $L_f$ stress calibration data, wherein for i=1 a first degree of deviation, $D_1$, is determined from comparing at least the $SP_{1,L1}$ and the $L_1$ stress calibration data;

j. obtaining a first substantially calibrated numerical model incorporating each modeled formation-stress analysis and modeled stress profile, the first model having degree of deviation $D_1$, wherein $D_1$ is greater than a pre-determined maximum deviation and the model incorporates stress calculations and formation stress-analysis;

k. predetermining, a second set of burial Poisson ratio values under element (d) wherein for i=2, $v_{n,Burial-i}$ is $v_{n,Burial-2}$;

l. performing the stress analysis of element (f) using at least each of the $GL_1$, the $H_n$ values, and, instead of the $v_{n,Burial-1}$ values, using the $v_{n,Burial-2}$ values to perform stress calculations on multiple points in the formation so that a second modeled formation-stress analysis, $FSA_2$, is produced;

m. producing from the $FSA_2$, a second set of modeled stress profiles, $SP_{2,Lf}$, wherein for $L_1$, a second set of modeled stress profiles, $SP_{2,L1}$, is produced;

n. determining a second degree of deviation, $D_2$, from comparing, respectively, each of $SP_{2,Lf}$ and the $L_f$ stress calibration data according to elements h) through i), wherein $D_2$ is determined from comparing at least $SP_{2,L1}$ to the $L_1$ stress calibration data; and o. obtaining the second substantially calibrated numerical model incorporating each modeled formation-stress analysis and modeled stress profile, the second model having degree of deviation $D_2$, wherein each set of $v_{n,Burial-1}$ and $v_{nBurial-2}$ values is correlated to $v_{n,Present}$ by a predetermined relationship, wherein each set of $v_{n,Burial-1}$ and $v_{n,Burial-2}$ values corresponds to a predetermined iteration constant, $X_i$, wherein for i=1 a first iteration constant, $X_1$, is predetermined and for i=2 a second iteration constant, $X_2$, is predetermined.

2. The method of claim 1 wherein the predetermined relationship correlating $v_{n,Burial-i}$ to $v_{n,Present}$ is defined by the relationship:

$$X_i = \left\{ \frac{v_{n,Burial-i} - v_{n,Present}}{(1 - v_{n,Present})(1 - 2v_{n,Burial-i})} \right\}$$

wherein, $X_i$ is a predetermined iteration value producing a set of $v_{n,Bural-i}$ values.

3. The method of claim 2 wherein $X_i$ is greater than zero and less than or equal to 5.

4. The method of claim 1, further comprising estimating stress in other locations of the formation based on at least one of the substantially calibrated numerical models.

5. The method of claim 1, further comprising estimating fracture pressure based on at least one of the substantially calibrated numerical models.

6. The method of claim 1, further comprising estimating fracture propagation based on at least one of the substantially calibrated numerical models.

7. The method of claim 1, further comprising modeling at least one of the group consisting of subsidence and fissure formation based on at least one of the substantially calibrated numerical models.

8. A method for producing a substantially calibrated numerical model, which can be used for calculating a stress on any point in a formation, the method comprising:

a. predetermining a number, n, of strata suitable for modeling the formation, wherein n=a whole integer≧1 and $s_n$ independently designates each stratum, respectively;

b. predetermining for each $s_n$ a corresponding thickness, $H_n$, and a corresponding present-day Poisson ratio, $v_{n,Present}$;

c. obtaining stress calibration data $L_f$, for at least one location in the formation, wherein for a first location in the formation, $L_f$=$L_1$ stress calibration data;

d. predetermining at least one set, i, of values comprising a burial Poisson ratio corresponding to each $s_n$, $v_{n,Burial-i}$, wherein each $v_{n,Burial-i}$≦0.5 and each $v_{n,Burial-i}$> $v_{n,present}$, wherein for i=1 a first set of values for burial Poisson ratio, $v_{n,Burial-1}$, is predetermined;

e. predetermining at least a 1st gravitational load, $GL_1$, associated with the formation;

f. using at least each of the $GL_1$, the $H_n$ and the $v_{n,Burial-i}$ values to perform stress calculations with a numerical modeling program on multiple points in the formation so that at least one modeled formation-stress analysis, $FSA_i$, can be produced, wherein for i=1 a first modeled formation-stress analysis, $FSA_i$, is produced with the numerical modeling program;

g. producing from each $FSA_i$ a corresponding set, i, of modeled stress profiles for $L_f$, $SP_{i,Lf}$, having at least one principal stress, wherein for i=1 and $L_1$, a first set of modeled stress profiles, $SP_{i,L1}$, is produced;

h. comparing each $SP_{i,Lf}$ to the $L_f$ stress calibration data, wherein for i=1 and $L_1$, $SP_{1,L1}$ is compared to the L, stress calibration data;

i. determining a degree of deviation, $D_i$, from comparing, respectively, each of $SP_{i,Lf}$ and the $L_f$ stress calibration data, wherein for i=1 a first degree of deviation, $D_1$, is determined from comparing at least the $SP_{1,L1}$ and the $L_1$, stress calibration data;

j. obtaining a first substantially calibrated numerical model incorporating each modeled formation-stress analysis and modeled stress profile, the first model having degree of deviation $D_1$, wherein $D_1$ is greater than a pre-determined maximum deviation and the model incorporates stress calculations and formation stress-analysis;

k. predetermining, a second set of burial Poisson ratio values under element (d) wherein for i=2, $v_{n,Burial-i}$ is $v_{n,Burial-2}$;

l. performing the stress analysis of element (f) using at least each of the $GL_1$, the $H_n$ values, and, instead of the $v_{n,Burial-1}$ values, using the $v_{n,Burial-2}$ values to perform stress calculations on multiple points in the formation so that a second modeled formation-stress analysis, $FSA_2$, is produced;

m. producing from the $FSA_2$, a second set of modeled stress profiles, $SP_{2,Lf}$, wherein for $L_1$, a second set of modeled stress profiles, $SP_{2,L1}$, is produced;

n. determining a second degree of deviation, $D_2$, from comparing, respectively, each of $SP_{2,Lf}$, and the $L_f$ stress calibration data according to elements h) through i), wherein $D_2$ is determined from comparing at least $SP_{2,L1}$ to the $L_1$ stress calibration data;

o. obtaining the second substantially calibrated numerical model incorporating each modeled formation-stress analysis and modeled stress profile, the second model having degree of deviation $D_2$, wherein $D_2$ is not acceptable for the formation-stress analysis desired;

p. predetermining at least one subsequent set, i+1, of burial Poisson ratio values, $v_{n,Burial-(i+1)}$, under element (d), different from any preceding set of predetermined $v_{n,Burial}$ values among all sets of $v_{n,Burial-1\ to\ i}$ values;

q. performing the stress analysis of element f) using at least each of the $GL_1$, the $H_n$ values, and, instead of any preceding set of predetermined $v_{n,Burial}$ values, using the $v_{n,Burial-(i+1)}$ values to perform stress calculations on multiple points in the formation so that a subsequent modeled formation-stress analysis, $FSA_{i+1}$, is produced;

r. producing from $FSA_{i+1}$ a corresponding subsequent set of modeled stress profiles, $SP_{i+1,Lf}$, wherein for $L_1$, a subsequent set of modeled stress profiles, $SP_{i+1,L1}$, is produced;

s. determining at least one subsequent degree of deviation, $D_{i+1}$, from comparing, respectively, each Of $SP_{i+1,Lf}$ and the $L_f$ stress calibration data according to elements (h) through (i), wherein $D_{i+1}$ is determined from comparing at least $SP_{i+1,L1}$ to the $L_1$ stress calibration data; and t. independently iterating elements (p),(q),(r), and (s), in accordance with the elements of this claim until $D_{i+1}$ is acceptable for the formation-stress analysis desired, wherein each $v_{n,Burial}$ value is correlated to $v_{n,Present}$ by a predetermined relationship, wherein each set of burial Poisson ratio values among all sets of $v_{n,Burial-1\ to\ (i+1)}$ values corresponds to a predetermined iteration constant, X, wherein for each independent iteration set, i, a different iteration constant, $X_i$, is predetermined and for each subsequent iteration, i+1, a subsequent iteration constant, $X_{i+1}$, is predetermined.

9. The method of claim 8 wherein the predetermined relationship correlating $v_{n,Burial-i}$ to $v_{n,Present}$ is defined by the relationship:

$$X_i = \left\{ \frac{v_{n,Burial-i} - v_{n,Present}}{(1 - v_{n,Present})(1 - 2v_{n,Burial-i})} \right\}$$

wherein, $X_i$ is a predetermined iteration value producing a set of $v_{n,Burial-i}$ values.

10. The method of claim 9 wherein $X_i$ is greater than zero and less than or equal to 5.

11. The method of claim 8, further comprising estimating stress in other locations of the formation based on at least one of the substantially calibrated numerical models.

12. The method of claim 8, further comprising estimating fracture pressure based on at least one of the substantially calibrated numerical models.

13. The method of claim 8, further comprising estimating fracture propagation based on at least one of the substantially calibrated numerical models.

14. The method of claim 8, further comprising modeling at least one of the group consisting of subsidence and fissure formation based on at least one of the substantially calibrated numerical models.

15. A method for producing a substantially calibrated numerical model, which can be used for calculating a stress on any point in a formation, the method comprising:

a. predetermining a number, n, of strata suitable for modeling the formation, wherein n=a whole integer≧1 and $s_n$ independently designates each stratum, respectively;

b. predetermining for each $S_n$ a corresponding thickness, $H_n$, and a corresponding present-day Poisson ratio, $v_{n,Present}$;

c. obtaining stress calibration data $L_f$, for at least one location in the formation, wherein for a first location in the formation, $L_f=L_1$ stress calibration data;

d. predetermining at least one set, i, of values comprising a burial Poisson ratio corresponding to each $s_n$, $v_{n,Burial-i}$, wherein each $v_{n,Burial-i} \leqq 0.5$ and each $v_{n,Burial-i} > v_{n,Present}$, wherein for i=1 a first set of values for burial Poisson ratio, $v_{n,Burial-1}$, is predetermined;

e. predetermining at least a $1^{st}$ gravitational load, $GL_1$, associated with the formation;

f. using at least each of the $GL_1$, the $H_n$ and the $v_{n,Burial-i}$ values to perform stress calculations with a numerical modeling program on multiple points in the formation so that at least one modeled formation-stress analysis, $FSA_i$, can be produced, wherein for i=1 a first modeled formation-stress analysis, $FSA_1$, is produced with the numerical modeling program;

g. producing from each $FSA_i$ a corresponding set, i, of modeled stress profiles for $L_f$, $SP_{i,Lf}$, having at least one principal stress, wherein for i=1 and $L_1$, a first set of modeled stress profiles, $SP_{i,Lf}$, is produced;

h. comparing each $SP_{i,Lf}$ to the $L_f$ stress calibration data, wherein for i=1 and $L_1$, $SP_{1,L1}$ is compared to the $L_1$ stress calibration data;

i. determining a degree of deviation, $D_i$, from comparing, respectively, each of $SP_{i,Lf}$ and the $L_f$ stress calibration data, wherein for i=1 a first degree of deviation, $D_1$, is determined from comparing at least the $SP_{1,L1}$ and the $L_1$ stress calibration data;

j. obtaining a first substantially calibrated numerical model incorporating each modeled formation-stress analysis and modeled stress profile, the first model having degree of deviation $D_1$, wherein $D_1$ is greater than a pre-determined maximum deviation and the model incorporates stress calculations and formation stress-analysis;

k. predetermining, a second set of burial Poisson ratio values under element (d) wherein for i=2, $v_{n,Burial-i}$ is $v_{n,Burial-2}$;

l. performing the stress analysis of element (f) using at least each of the $GL_1$, the $H_n$ values, and, instead of the $v_{n,Burial-1}$ values, using the $v_{n,Burial-2}$ values to perform stress calculations on multiple points in the formation so that a second modeled formation-stress analysis, $FSA_2$, is produced;

m. producing from the $FSA_2$, a second set of modeled stress profiles, $SP_{2,Lf}$, wherein for $L_1$, a second set of modeled stress profiles, $SP_{2,L1}$, is produced;

n. determining a second degree of deviation, $D_2$, from comparing, respectively, each of $SP_{2,Lf}$ and the $L_f$ stress calibration data according to elements h) through i), wherein $D_2$ is determined from comparing at least $SP_{2,L1}$ to the $L_1$ stress calibration data; and o. obtaining the second substantially calibrated numerical model incorporating each modeled formation-stress analysis and modeled stress profile, the second model having degree of deviation $D_2$, wherein in element (f), using at least one set, i, of predetermined tectonic conditions to produce at least one modeled tectonic event, $T_i$, wherein for i=1 a first modeled tectonic event, $T_1$, is produced; and in element (k), predetermining a second set of predetermined tectonic conditions to produce a second modeled tectonic event, $T_2$; and using $T_2$ in element (l); and wherein each set of $v_{n,Burial-1}$ and $v_{n,Burial-2}$ values is correlated to $v_{n,\ Present}$ by a predetermined relationship, wherein each set of $v_{n,Burial-1}$ and $v_{n,Burial-2}$ values corresponds to a predetermined iteration constant, $X_i$, wherein for i=1 a first iteration constant, $X_1$, is predetermined and for i=2 a second iteration constant, $X_2$, is predetermined.

16. The method of claim 15 wherein the predetermined relationship correlating $v_{n,Burial-i}$ to $v_{n,Present}$ is defined by the relationship:

$$X_i = \left\{ \frac{v_{n,Burial-i} - v_{n,Present}}{(1 - v_{n,Present})(1 - 2v_{n,Burial-i})} \right\}$$

wherein, $X_i$, is a predetermined iteration value producing a set of $v_{n,Burial-i}$ values.

17. The method of claim 16 wherein $X_i$, is greater than zero and less than or equal to 5.

18. The method of claim 15, further comprising estimating stress in other locations of the formation based on at least one of the substantially calibrated numerical models.

19. The method of claim 15, further comprising estimating fracture pressure based on at least one of the substantially calibrated numerical models.

20. The method of claim 15, further comprising estimating fracture propagation based on at least one of the substantially calibrated numerical models.

21. The method of claim 15, further comprising modeling at least one of the group consisting of subsidence and fissure formation based on at least one of the substantially calibrated numerical models.

22. A method for producing a substantially calibrated numerical model, which can be used for calculating a stress on any point in a formation, the method comprising:

a. predetermining a number, n, of strata suitable for modeling the formation, wherein n=a whole integer≧1 and $s_n$ independently designates each stratum, respectively;

b. predetermining for each $s_n$ a corresponding thickness, $H_n$, and a corresponding present-day Poisson ratio, $v_{n,Present}$;

c. obtaining stress calibration data $L_f$, wherein for a first location in the formation, $L_f=L_1$ stress calibration data;

d. predetermining at least one set, i, of values comprising a burial Poisson ratio corresponding to each $s_n$, $v_{n,Burial-i}$, wherein each $v_{n,Burial-i} \leqq 0.5$ and each $v_{n,Burial-i} > v_{n,Present}$, wherein for i =1 a first set of values for burial Poisson ratio, $v_{n,Burial-1}$, is predetermined;

e. predetermining at least a $1^{st}$ gravitational load, $GL_1$, associated with the formation;

f. using at least each of the $GL_1$, the $H_n$ and the $v_{n,Burial-i}$ values to perform stress calculations with a numerical modeling program on multiple points in the formation so that at least one modeled formation-stress analysis, $FSA_i$, can be produced, wherein for i=1 a first modeled formation-stress analysis, $FSA_1$, is produced with the numerical modeling program;

g. producing from each $FSA_i$ a corresponding set, i, of modeled stress profiles for $L_f$, $SP_{i,Lf}$, having at least one principal stress, wherein for i=1 and $L_1$, a first set of modeled stress profiles, $SP_{1,L1}$, is produced;

h. comparing each $SP_{i,Lf}$ to the $L_f$ stress calibration data, wherein for i=1 and $L_1$, $SP_{1,L1}$ is compared to the $L_1$ stress calibration data;

i. determining a degree of deviation, $D_i$, from comparing, respectively, each of $SP_{i,Lf}$ and the $L_f$ stress calibration data, wherein for i=1 a first degree of deviation, $D_1$, is determined from comparing at least the $SP_{1,L1}$ and the $L_1$ stress calibration data;

j. obtaining a first substantially calibrated numerical model incorporating each modeled formation-stress analysis and modeled stress profile, the first model having degree of deviation $D_1$, wherein $D_1$ is greater than a pre-determined maximum deviation and the model incorporates stress calculations and formation stress-analysis;

k. predetermining, a second set of burial Poisson ratio values under element (d) wherein for i=2, $v_{n,Burial-i}$ is $v_{n,Burial-2}$;

l. performing the stress analysis of element (f) using at least each of the $GL_1$, the $H_n$ values, and, instead of the $v_{n,Burial-1}$ values, using the $v,_{n,Burial-1}$ values to perform stress calculations on multiple points in the formation so that a second modeled formation-stress analysis, $FSA_2$, is produced;

m. producing from the $FSA_2$, a second set of modeled stress profiles, $SP_{2,Lf}$, wherein for $L_1$, a second set of modeled stress profiles, $SP_{2,L1}$, is produced;

n. determining a second degree of deviation, $D_2$, from comparing, respectively, each of $SP_{2,Lf}$ and the $L_f$ stress calibration data according to elements h) through i), wherein $D_2$ is determined from comparing at least $SP_{2,L1}$ to the $L_1$ stress calibration data;

o. obtaining the second substantially calibrated numerical model incorporating each modeled formation-stress analysis and modeled stress profile, the second model having degree of deviation $D_2$, wherein $D_2$ is not acceptable for the formation-stress analysis desired;

p. predetermining at least one subsequent set, i+1, of burial Poisson ratio values, $v_{n,Burial-(i+1)}$, under element (d), different from any preceding set of predetermined $v_{n,Burial}$ values among all sets of $v_{n,Burial-1\ to\ i}$ values;

q. performing the stress analysis of element f) using at least each of the $GL_1$, the $H_n$ values, and, instead of any preceding set of predetermined $v_{n,Burial}$ values, using the $v_{n,Burial-(i+1)}$ values to perform stress calculations on multiple points in the formation so that a subsequent modeled formation-stress analysis, $FSA,_{i+1}$, is produced;

r. producing from $FSA_{i+1}$ a corresponding subsequent set of modeled stress profiles, $SP_{i+1,Lf}$, wherein for $L_1$, a subsequent set of modeled stress profiles, $SP_{i+1,L1}$, is produced;

s. determining at least one subsequent degree of deviation, $D_{i+1}$, from comparing, respectively, each of $SP_{i+1,Lf}$ and the $L_f$ stress calibration data according to elements (h) through i), wherein $D_{i+1}$ is determined from comparing at least $SP_{i+1,L1}$ to the $L_1$ stress calibration data; and t. independently iterating elements (p),(q),(r), and (s), in accordance with the elements of this claim until $D_{i+1}$ is acceptable for the formation-stress analysis desired, wherein in element (f), using at least one set, i, of predetermined tectonic conditions to produce at least one modeled tectonic event, $T_i$, wherein for i=1 a first modeled tectonic event, $T_1$, is produced; and in element (p), predetermining at least one subsequent second set, i+1, of predetermined tectonic conditions to produce at least one subsequent modeled tectonic event, $T_{i+1}$, and using $T_{i+1}$ in element (q); and wherein each $v_{n,Burial}$ value is correlated to $v_{n,Present}$ by a predetermined relationship, wherein each set of burial Poisson ratio values among all sets of $v_{n,Burial-1\ to\ (i+1)}$ values corresponds to a predetermined iteration constant, X, wherein for each independent iteration set, i, a different iteration constant, $X_i$, is predetermined and for each subsequent iteration, i+1, a subsequent iteration constant, $X_{i+1}$, is predetermined.

23. The method of claim 22 wherein the predetermined relationship correlating $v_{n,Burial-i}$ to $v_{n,Present}$ is defined by the relationship:

$$X_i = \left\{ \frac{v_{n,Burial-i} - v_{n,Present}}{(1 - v_{n,Present})(1 - 2v_{n,Burial-i})} \right\}$$

wherein, $X_i$ is a predetermined iteration value producing a set of $v_{n,Burial-i}$ values.

24. The method of claim 23 wherein $X_i$ is greater than zero and less than or equal to 5.

25. The method of claim 22, further comprising estimating stress in other locations of the formation based on at least one of the substantially calibrated numerical models.

26. The method of claim 22, further comprising estimating fracture pressure based on at least one of the substantially calibrated numerical models.

27. The method of claim 22, further comprising estimating fracture propagation based on at least one of the substantially calibrated numerical models.

28. The method of claim 22, further comprising modeling at least one of the group consisting of subsidence and fissure formation based on at least one of the substantially calibrated numerical models.

29. A method for producing a substantially calibrated numerical model, which can be used for calculating a stress on any point in a formation, the method comprising:

a. predetermining a number, n, of strata suitable for modeling the formation, wherein n=a whole integer≧1 and $s_n$ independently designates each stratum, respectively;

b. predetermining for each $s_n$ a corresponding thickness, $H_n$, and a corresponding present-day Poisson ratio, $v_{n,Present}$;

c. obtaining stress calibration data $L_f$, for at least one location in the formation, wherein for a first location in the formation, $L_f$=$L_1$ stress calibration data;

d. predetermining at least one set, i, of values comprising a burial Poisson ratio corresponding to each $s_n$, $v_{n,Burial-i}$, wherein each $v_{n,Burial-i}$≦0.5 and each $v_{n,Burial-i}$> $v_{n,Present}$, wherein for i=1 a first set of values for burial Poisson ratio, $v_{n,Burial-1}$, is predetermined;

e. predetermining at least a 1$^{st}$gravitational load, $GL_1$, associated with the formation;

f. using at least each of the $GL_1$, the $H_n$ and the $v_{n,Burial-i}$ values to perform stress calculations with a numerical modeling program on multiple points in the formation so that at least one modeled formation-stress analysis, $FSA_i$, can be produced, wherein for i=1 a first modeled formation-stress analysis, $FSA_1$, is produced with the numerical modeling program;

g. producing from each $FSA_i$ a corresponding set, i, of modeled stress profiles for $L_f$, $SP_{i,Lf}$, having at least one principal stress, wherein for i=1 and $L_1$, a first set of modeled stress profiles, $SP_{1,L1}$, is produced;

h. comparing each $SP_{i,Lf}$ to the $L_f$ stress calibration data, wherein for i=1 and $L_1$, $SP_{1,L1}$ is compared to the $L_1$ stress calibration data;

i. determining a degree of deviation, $D_i$, from comparing, respectively, each of $SP_{i,Lf}$ and the $L_f$ stress calibration data, wherein for i=1 a first degree of deviation, $D_1$, is determined from comparing at least the $SP_{1,L1}$ and the $L_1$ stress calibration data; and j. obtaining the substantially calibrated numerical model incorporating each modeled formation-stress analysis and modeled stress profile, the first model having degree of deviation $D_1$, wherein $D_1$ is greater than a pre-determined maximum deviation and the model incorporates stress calculations and formation stress-analysis, wherein the set of $v_{n,Burial\text{-}i}$ values is correlated to $v_{n,Present}$ by a predetermined relationship;

wherein the predetermined relationship correlating $v_{n,Burial\text{-}i}$ to $v_{n,Present}$ is defined by the relationship:

$$X_1 = \left\{ \frac{v_{n,Burial-1} - v_{n,Present}}{(1 - v_{n,Present})(1 - 2v_{n,Burial-1})} \right\}$$

wherein, $X_i$ is a predetermined value producing a set of $v_{n,Burial\text{-}i}$ values.

30. The method of claim 29 wherein $X_i$, is greater than zero and less than or equal to 5.

31. The method of claim 29, further comprising estimating stress in other locations of the formation based on at least one of the substantially calibrated numerical models.

32. The method of claim 29, further comprising estimating fracture pressure based on at least one of the substantially calibrated numerical models.

33. The method of claim 29, further comprising estimating fracture propagation based on at least one of the substantially calibrated numerical models.

34. The method of claim 29, further comprising modeling at least one of the group consisting of subsidence and fissure formation based on at least one of the substantially calibrated numerical models.

* * * * *